US007111827B2

(12) United States Patent
Sicking et al.

(10) Patent No.: US 7,111,827 B2
(45) Date of Patent: Sep. 26, 2006

(54) ENERGY-ABSORPTION SYSTEM

(75) Inventors: Dean L. Sicking, Lincoln, NE (US); Brian G. Pfeifer, Lincoln, NE (US)

(73) Assignee: Kothmann Enterprises, Inc., Big Spring, TX (US)

( * ) Notice: Subject to any disclaimer, the term of this patent is extended or adjusted under 35 U.S.C. 154(b) by 0 days.

(21) Appl. No.: 10/236,755

(22) Filed: Sep. 6, 2002

(65) Prior Publication Data

US 2003/0025112 A1 Feb. 6, 2003

Related U.S. Application Data

(60) Continuation of application No. 09/410,635, filed on Oct. 1, 1999, now Pat. No. 6,505,820, which is a division of application No. 08/335,153, filed on Nov. 7, 1994, now Pat. No. 6,022,003.

(51) Int. Cl.
*A01K 3/00* (2006.01)

(52) U.S. Cl. ..... 256/13.1; 256/17; 256/59; 404/6; 404/9; 404/10

(58) Field of Classification Search ..... 256/13.1, 256/17, 59; 404/6, 9, 10; 293/133
See application file for complete search history.

(56) References Cited

U.S. PATENT DOCUMENTS

| | | | |
|---|---|---|---|
| 2,837,176 | A | 6/1958 | Dropkin |
| 2,877,170 | A | 3/1959 | Greenhalgh et al. |
| 2,961,204 | A | 11/1960 | Rayfield et al. |
| 3,038,175 | A | 6/1962 | Faget et al. |
| 3,082,846 | A | 3/1963 | Jensen et al. |
| 3,143,321 | A | 8/1964 | McGehee et al. |

(Continued)

FOREIGN PATENT DOCUMENTS

| | | |
|---|---|---|
| AU | 724157 | 10/1998 |
| CA | 472071 | 3/1951 |
| CA | 22-04528 | 5/1966 |
| CA | 2285217 | 10/1998 |
| EP | 0163524 | 12/1985 |
| EP | 0903265 | 3/1999 |
| GB | 884953 | 7/1960 |
| JP | 60-260730 | 12/1985 |
| WO | WO 96/13972 | 5/1996 |
| WO | WO 98/44203 | 10/1998 |

OTHER PUBLICATIONS

Additional papers filed/server in re: Kothmann & Kothmann v. Trinity Industries, Inc., No. (S.D. Texas) (see attached list) see attached for dates.

Sep. 30, 2005, Memorandum and Opinion (denying Plaintiff Kothmann Enterprises, Inc.'s Motion for Parital Summary Judgment of Infringement; Granting Defendant Trinity Industries, Inc.'s Motion for Summary Judgment of Non–Infringement; Denying Defendant's Motion for Summary Judgment of Invalidity; and Granting Plaintiff's Motion for Partial Summary Judgment on Standing.

Jan. 13, 2006, Memorandum and Order ruling no inequitable conduct and no prosecution laches from May 2005 bench trial; and granting in part and denying in part Defendant's Motion Strike Trial Brief.

Jan. 27, 2006, Plaintiff's Proposed Final Judgment.

(Continued)

*Primary Examiner*—Hugh B. Thompson, II
(74) *Attorney, Agent, or Firm*—Charles J. Rogers; Conley Rose, P.C.

(57) ABSTRACT

To reduce the danger of bodily harm to occupants of vehicles that leave a roadway, a guardrail system includes an energy-absorption system is provided. The energy-absorption system including a cutting mechanism positioned to cut a guardrail section upon impact by a vehicle to decelerate the vehicle.

39 Claims, 6 Drawing Sheets

U.S. PATENT DOCUMENTS

| | | | | |
|---|---|---|---|---|
| 3,198,288 | A | | 8/1965 | Presunka |
| 3,200,584 | A | | 8/1965 | Mitchell |
| 3,232,383 | A | | 2/1966 | Moberg |
| 3,236,333 | A | | 2/1966 | Mitchell |
| 3,265,163 | A | | 8/1966 | Gilbert et al. |
| 3,284,122 | A | | 11/1966 | Rich |
| 3,369,634 | A | | 2/1968 | Mazelsky |
| 3,381,778 | A | | 5/1968 | Tiesenhausen |
| 3,385,564 | A | | 5/1968 | Persicke |
| 3,428,150 | A | | 2/1969 | Muspratt |
| 3,438,674 | A | | 4/1969 | Radke et al. |
| 3,450,233 | A | | 6/1969 | Massa |
| 3,596,963 | A | | 7/1969 | Phillips |
| 3,492,888 | A | | 2/1970 | Nishimura et al. |
| 3,512,822 | A | | 5/1970 | Rich et al. |
| 3,574,376 | A | | 4/1971 | Cummins |
| 357,787 | A | | 6/1971 | Rich et al. |
| 3,600,003 | A | | 8/1971 | Carey |
| 3,606,258 | A | | 9/1971 | Fitch |
| 3,608,677 | A | | 9/1971 | Wykes |
| 3,628,634 | A | | 12/1971 | Valukonis |
| 3,633,934 | A | | 1/1972 | Wilfert |
| 3,635,314 | A | | 1/1972 | Mazelsky |
| 3,653,468 | A | | 4/1972 | Marshall |
| 3,695,583 | A | | 10/1972 | Walker et al. |
| 3,717,326 | A | | 2/1973 | Leach et al. |
| 3,749,205 | A | | 7/1973 | Fletcher et al. |
| 3,751,089 | A | | 8/1973 | Lefeuvre |
| 3,779,591 | A | | 12/1973 | Rands |
| 3,782,505 | A | | 1/1974 | Armstrong |
| 3,805,418 | A | | 4/1974 | Matuka et al. |
| 3,819,218 | A | | 6/1974 | Liu |
| 3,847,252 | A | | 11/1974 | Casciola |
| 3,853,298 | A | | 12/1974 | Libkie et al. |
| 3,865,418 | A | | 2/1975 | Saxl |
| 3,866,367 | A | | 2/1975 | Stizki |
| 3,893,726 | A | | 7/1975 | Stohschein |
| 3,997,133 | A | | 12/1976 | Fagan |
| 4,118,014 | A | | 10/1978 | Frosch et al. |
| 4,273,361 | A | | 6/1981 | Takei et al. |
| 4,321,989 | A | | 3/1982 | Meinzer |
| 4,330,106 | A | | 5/1982 | Chisholm |
| 4,341,291 | A | | 7/1982 | Flory et al. |
| 4,346,795 | A | | 8/1982 | Herbert |
| 4,352,484 | A | | 10/1982 | Gertz et al. |
| 4,655,434 | A | | 4/1987 | Bronstad ..... 256/13.1 |
| 4,666,130 | A | | 5/1987 | Denman et al. |
| 4,815,565 | A | | 3/1989 | Sicking et al. |
| 4,823,923 | A | | 4/1989 | Moyer |
| 4,838,523 | A | | 6/1989 | Humble et al. |
| 4,928,928 | A | | 5/1990 | Buth et al. ..... 256/13.1 |
| 5,022,782 | A | | 6/1991 | Gertz et al. ..... 404/6 |
| 5,044,609 | A | | 9/1991 | Cicinnati et al. |
| 5,078,366 | A | | 1/1992 | Sicking et al. ..... 256/13.1 |
| 5,090,755 | A | | 2/1992 | Garnweidner |
| 5,096,242 | A | | 3/1992 | Chin-Hun |
| 5,217,318 | A | | 6/1993 | Peppel |
| 5,222,915 | A | | 6/1993 | Petrzelka et al. |
| 5,238,228 | A | | 8/1993 | Moon ..... 256/13.1 |
| 5,366,181 | A | | 11/1994 | Hansen |
| 5,391,016 | A | | 2/1995 | Ivey et al. ..... 404/6 |
| 5,403,113 | A | | 4/1995 | Gertz et al. ..... 404/6 |
| 5,407,298 | A | | 4/1995 | Sicking et al. |
| 5,431,447 | A | | 7/1995 | Bauer |
| 5,503,495 | A | | 4/1996 | Mak et al. |
| 5,547,309 | A | | 8/1996 | Mak et al. |
| 5,765,811 | A | | 6/1998 | Alberson et al. |
| 5,775,675 | A | | 7/1998 | Sicking et al. |
| 5,791,812 | A | | 8/1998 | Ivey |
| 5,797,591 | A | | 8/1998 | Krage |
| 5,851,005 | A | * | 12/1998 | Muller et al. ..... 256/13.1 |
| 5,924,680 | A | | 7/1999 | Sicking et al. |
| 5,931,448 | A | | 8/1999 | Sicking et al. |
| 5,947,452 | A | | 9/1999 | Albritton |
| 5,957,435 | A | * | 9/1999 | Bronstad ..... 256/13.1 |
| 5,988,598 | A | | 11/1999 | Sicking et al. |
| 6,022,003 | A | * | 2/2000 | Sicking et al. ..... 256/13.1 |
| 6,109,597 | A | * | 8/2000 | Sicking et al. ..... 256/13.1 |
| 6,129,342 | A | | 10/2000 | Bronstad |
| 6,173,943 | B1 | * | 1/2001 | Welch et al. ..... 256/13.1 |
| 6,179,516 | B1 | * | 1/2001 | Ivey et al. ..... 256/13.1 X |
| 6,244,571 | B1 | * | 6/2001 | Reid et al. ..... 256/13.1 |
| 6,254,063 | B1 | | 7/2001 | Rohde et al. |
| 6,260,827 | B1 | | 7/2001 | Sicking et al. |
| 6,293,727 | B1 | * | 9/2001 | Albritton ..... 256/13.1 X |
| 6,299,141 | B1 | * | 10/2001 | Lindsay et al. ..... 256/13.1 |
| 6,308,809 | B1 | | 10/2001 | Reid et al. |
| 6,409,417 | B1 | * | 6/2002 | Muller et al. ..... 256/13.1 X |
| 6,416,041 | B1 | * | 7/2002 | Sicking et al. ..... 256/13.1 |
| 6,435,761 | B1 | * | 8/2002 | Bligh et al. ..... 256/13.1 X |
| 6,461,076 | B1 | * | 10/2002 | Stephens et al. ..... 256/13.1 X |
| 6,481,920 | B1 | * | 11/2002 | Leonhardt et al. ..... 256/13.1 X |
| 6,505,820 | B1 | * | 1/2003 | Sicking et al. ..... 256/13.1 |
| 2001/0014254 | A1 | | 8/2001 | Albritton |
| 2002/0024043 | A1 | * | 2/2002 | Albritton ..... 256/13.1 |
| 2002/0066896 | A1 | * | 6/2002 | Bligh et al ..... 256/13.1 |
| 2002/0090260 | A9 | * | 7/2002 | Albritton ..... 256/13.1 X |
| 2002/0158241 | A1 | * | 10/2002 | Ochoa ..... 256/13.1 |
| 2003/0034484 | A1 | * | 2/2003 | Buth et al. ..... 256/13.1 |
| 2003/0151038 | A1 | * | 8/2003 | Alberson et al. ..... 256/13.1 |
| 2003/0175076 | A1 | * | 9/2003 | Albritton ..... 404/6 |
| 2004/0016916 | A1 | * | 1/2004 | Bronstad ..... 256/13.1 |

OTHER PUBLICATIONS

Jan. 27, 2006, Defendant's Notice of Identification of Remaining Issues to be Adjudicated.

Jan. 31, 2006, Notice of Setting for Miscellaneous Hearing on Feb. 10, 2006 at 02:00 p.m. in Courtroom 11B before Judge Lee H. Rosenthal.

Feb. 21, 2006, Joint Motion to Continue Trial.

Feb. 23, 2006, Order granting Joint Motion to Continue Trial.

Feb. 24, 2006, Plaintiff's Motion for Court to Decline to Exercise Discretion to Hold Jury Trial.

Papers filed/served in re Kothmann & Kothmann v. Trinity Industries, Inc., No. H–01–2668 (S.D. Texas) (see attached list).

Aug. 8, 2001, Kothmann & Kothmann's Original Complaint (Dkt. Entry 1).

Aug. 8, 2001, Order For Conference (Dkt. Entry 2).

Aug. 8, 2001, Kothmann & Kothmann's Motion for Preliminary Injunction (Dkt. Entry 3).

Aug. 17, 2001, Return of Service (Dkt. Entry 4).

Aug. 29, 2001, Trinity Industries, Inc.'s Original Answer and Counterclaim (Dkt. Entry 5).

Aug. 29, 2001, Defendant's Response In Opposition to Plaintiff's Motion for Preliminary Injunction (Dkt. Entry 6).

Aug. 29, 2001, Unopposed Motion for Russell Brown to Appear Pro Hac Vice (Dkt. Entry 7).

Aug. 30, 2001, Defendant's Motion for Leave to File Supplemental Response to Plaintiff's Motion for Preliminary Injunction (Dkt. Entry 8).

Aug. 31, 2001, Order (for admission *pro hac vice*) (Dkt. Entry 9).

Sep. 18, 2001, Order Granting Motion for Leave to File Supplemental Response [to Motion for Preliminary Injunction] (Dkt. Entry 10).

Sep. 24, 2001, Trinity Industries, Inc.'s Supplemental Response in Opposition to Plaintiff's Motion for Preliminary Injunction (Dkt. Entry 11).
Sep. 24, 2001, Appendix to Trinity Industries, Inc.'s Supplemental Response In Opposition to Plaintiff's Motion for Preliminary Injunction (Dkt. Entry 12).
Sep. 25, 2001, Plaintiff Kothmann & Kothmann, Inc.'s Unopposed Motion for Leave to File Reply to Defendant Trinity Industries, Inc.'s Response and Supplemental Response In Opposition to Plaintiff's Motion for Preliminary Injunction (Dkt. Entry 13).
Sep. 25, 2001, Plaintiff Kothmann & Kothmann, Inc.'s Disclosure of Interested Parties (Dkt. Entry 14).
Sep. 28, 2001, Order Granting Plaintiff Kothmann & Kothmann, Inc.'s Unopposed Motion for Leave to File Reply to Defendant Trinity Industries, Inc.'s Response and Supplemental Response In Opposition to Plaintiff's Motion for Preliminary Injunction (Dkt. Entry 15).
Sep. 28, 2001, Order for Hearing [on Motion for Preliminary Injunction] (Dkt. Entry 16).
Oct. 16, 2001, Trinity Industries' Motion for Summary Judgment (Dkt. Entry 17).
Oct. 16, 2001, Defendant Trinity Industries, Inc.'s Brief in Support of Motion for Summary Judgment: Appendix to Brief (Dkt. Entry 18).
Oct. 18, 2001, Docket entry—parties given notice of cancellation of conference (Dkt. Entry 19).
Oct. 18, 2001, Joint Discovery/Case Management Plan Under Rule 26(f) FRCP (Dkt. Entry 20).
Oct, 19, 2001, Trinity Industries Disclosure of Interested Parties (Dkt. Entry 21).
Nov. 7, 2001, Plaintiff Kothmann & Kothmann, Inc.'s Response In Opposition to Defendant Trinity Industries, Inc.'s Motion for Summary Judgment of Invalidity (Dkt. Entry 22).
Nov. 7, 2001, Kothmann's Revised Unopposed Motion to Change Hearing Date (Dkt. Entry 23).
Nov. 7, 2001, Kothmann's Unopposed Motion to Change Hearing Date [on Plaintiff's Motion for Preliminary Injunction] (Dkt. Entry 25).
Nov. 8, 2001, Order [granting Motion to Change Hearing Date on Plaintiff's Revised Unopposed Motion for a Preliminary Injunction] (Dkt. Entry 24).
Nov. 19, 2001, Motion for Guy Manning to Appear Pro Hac Vice (Dkt. Entry 26).
Nov. 26, 2001, Order (granting Motion to Appear Pro Hac Vice (Dkt. Entry 27).
Nov. 30, 2001, Plaintiff's Initial Disclosures Under Rule 26(a)(1).
Nov. 30, 2001, Defendant's Initial Disclosures Under Rule 26(a)(1).
Dec. 4, 2001, [Agreed] Motion to Change Hearing Date (Dkt. Entry 28).
Dec. 6, 2001, Order (granting Agreed Motion to Change Hearing Date) (Dkt. Entry 29).
Dec, 17, 2001, Reply in Support of Trinity Industries, Inc.'s Motion for Summary Judgment (Dkt. Entry 30).
Dec. 26, 2001, Kothmann & Kothmann's Motion to Change Hearing Date [on Plantiff's Motion for Preliminary Injunction] (Dkt. Entry 31).
Jan. 14, 2002, Order (granting Motion for Continuance of Hearing Date on Motion for Preliminary Injunction) (Dkt. Entry 32).
Feb. 21, 2002, Plaintiff Kothmann & Kothmann, Inc.'s Supplemental Initial Disclosures Pursuant to Rule 26.
Feb. 22, 2002, Trinity Industries, Inc.'s Supplemental and Revised Rule 26(a)(l) Disclosures and Rule 26(a)(2) Disclosures.
Feb. 26, 2002, Plaintiff Kothmann & Kothmann, Inc.'s Reply to Defendant Trinity Industries, Inc.'s Response and Supplemental Response in Opposition to Plaintiff's Motion for Preliminary Injunction (Dkt. Entry 33).
Feb. 26, 2002, Unopposed Motion for Steven E. Ross to Appear Pro Hac Vice (Dkt. Entry 34).
Feb. 27, 2002, Expedited Motion for Continuance or, In the Alternative, To Strike Plaintiff's Reply and Preclude Testimony of Expert Witnesses (Dkt. Entry 35).
Feb. 27, 2002, Submission of Rebuttal Declaration [of Rodney A. Boyd] (Dkt. Entry 36).
Feb. 27, 2002, Minute Entry: Hearing held granting Motion for Continuance on Plaintiff's Motion for Preliminary Injunction (Dkt. Entry 37).
Feb. 28, 2002, Order (granting Motion to Appear Pro Hac Vice (Dkt. Entry 38).
Feb. 28, 2002, Trinity Industries, Inc.'s Notice of Deposition of Dean L. Sicking.
Feb. 28, 2002, Trinity Industries, Inc.'s Notice of Deposition of Kaddo F. Kothmann.
Mar. 1, 2002, Trinity Industries, Inc.'s First Set of Interrogatories to Kothmann & Kothmann, Inc.
Mar. 4, 2002, Trinity Industries, Inc.'s Amended Notice of Deposition of Kaddo F. Kothmann.
Mar. 15, 2002, Notice of Videotaped Oral Deposition of Rodney Boyd.
Mar. 15, 2002, Notice of Videotaped Oral Deposition of James Albritton.
Mar. 15, 2002, Notice of Videotaped Oral Deposition of Maurice Bronstad with Subpoena Duces Tecum.
Mar. 15, 2002, Amended Notice of Deposition of James Allbritton.
Mar. 21, 2002, Notice of Videotaped Oral Deposition of Michael O. Sutton.
Mar. 21, 2002, Amended Notice of Videotaped Oral Deposition of Maurice Bronstad With Subpoena Duces Tecum.
Mar. 21, 2002, Trinity's Notice of Deposition of Paul F. Packman.
Mar. 21, 2002, Trinity's Notice of Deposition of Alan H. Gordon.
Mar. 25, 2002, Amended Notice of Videotaped Oral Deposition of Michael O. Sutton.
Mar. 26, 2002, Plaintiff Kothmann & Kothmann, Inc.'s and Defendant Trinity Industries, Inc.'s Joint Motion for Entry of Agreed Protective Order (Dkt. Entry 39).
Mar. 26, 2002, Notice of Videotaped Oral Deposition of Eugene Buth w/ Subpoena Duces Tecum.
Mar. 27, 2002, Amended Notice of Oral Deposition of Stephen L. Brown.
Mar. 27, 2002, Objections and Responses to Subpoena Duces Tecum Issued to Maurice Bronstad.
Mar. 28, 2002, Agreed Protective Order (Dkt. Entry 40).
Mar. 28, 2002, Second Amended Notice of Videotaped Oral Deposition of Michael O. Sutton with Subpoena Duces Tecum.
Mar. 28, 2002, Amended Notice of Deposition of Alan Gordon with Subpoena Duces Tecum.
Mar. 28, 2002, Amended Notice of Deposition of Paul F. Packman w/Subpoena Duces Tecum.

Mar. 29, 2002, Plaintiff Kothmann & Kothmann, Inc.'s Notice of Filing / Serving Expert Report of Alan Gordon in Support of Plaintiff's Response in Opposition to Trinity Industries, Inc.'s Motion for Summary Judgment on Invalidity (Dkt. Entry 41).

Apr. 1, 2002, Plaintiff Kothmann & Kothmann, Inc.'s Answers and Objections to Trinity Industries, Inc.'s First Set of Interrogatories.

Apr. 4, 2002, Defendant Trinity Industries, Inc.'s Responses to Plaintiff Kothmann & Kothmann, Inc.'s First Set of Interrogatories.

Apr. 5, 2002, Trinity Industries' Witness List (Dkt. Entry 46).

Apr. 9, 2002, Minute Entry: 1st Day of Preliminary Injunction Hearing (Dkt. Entry 43).

Apr. 10, 2002, Transcript of Proceedings —Hearing on Motion for Preliminary Injunction [vol. 1 –Apr. 5, 2002] (Dkt. Entry 42).

Apr. 10, 2002, Defendant's Designation of Deposition Testimony —Kaddo Kothmann —Mar. 6, 2000 (Dkt. Entry 45).

Apr. 11, 2002, Transcript of Proceedings —Hearing on Motion for preliminary Injunction [vol. 2 –Apr. 11, 2002] (Dkt. Entry 47).

Apr. 11, 2002, Supplemental Memorandum in Opposition to Plaintiff's Motion for Preliminary Injunction (Dkt. Entry 44).

Apr. 11, 2002, Minute Entry: Conference held —denied as moot Motion to Quash Subpoena (Dkt. Entry 49).

Apr. 12, 2002, Minute Entry: 3rd day Preliminary Injunction Hearing (Dkt. Entry 50).

Apr. 12, 2002, Transcript of Proceedings —Hearing on Motion for Preliminary Injunction [vol. 3 –Apr. 12, 2002] (Dkt. Entry 48).

Apr. 16, 2002, Subpoena to Trinity Industries, Inc.

Apr. 18, 2002, Minute Entry: telephone conference re scheduling issues of day 4 of Preliminary Injunction Hearing (Dkt. Entry 52).

Apr. 19, 2002, Defendant's Objections and Responses to Subpoena Issued to Trinity Industries, Inc.

Apr. 22, 2002, Motion to Quash Subpoena issued by Trinity Industries, Inc. (Dkt. Entry 51).

Apr. 23, 2002, Subpoena to Trinity Industries, Inc.

Apr. 25, 2002, Minute Entry : telephone conference re Motion to Quash Subpoena (Dkt. Entry 53).

Apr. 26, 2002, Defendant's Objections and Responses to Subpoena Issued to Trinity Industries, Inc.

Apr. 29, 2002, Minute Entry: 4th Day of Preliminary Injunction Hearing —Plaintiff and Defendant to file Findings of Fact and Conclusions of Law (Dkt. Entry 55).

Apr. 29, 2002, Plaintiff's Exhibit List (Dkt. Entry 56).

Apr. 29, 2002, Defendant's Exhibit List (Dkt. Entry 57).

May 3, 2002, [Plaintiff's ] Request for Production of Documents.

May 7, 2002, Transcript of Proceedings of Preliminary Injunction Hearing [vol. 4 –Apr. 29, 2002] (Dkt. Entry 54).

May 14, 2002, Plaintiff Kothmann & Kothmann, Inc.'s Proposed Findings of Fact and Conclusions of Law in Support of Preliminary Injunction (Dkt. Entry 58).

May 20, 2002, Defendant Trinity Industries, Inc.'s Proposed Findings of Fact and Conclusions of Law Denying Plaintiff's Motion for Preliminary Injunction (Dkt. Entry 59).

May 22, 2002, Plaintiff's Answer to Defendant's Counterclaim (Dkt. Entry 60).

Jun. 5, 2002, Defendant Trinity Industries, Inc.'s Objections and Responses to Plaintiff Kothmann & Kothmann, Inc.'s Request for Production of Documents.

Jun. 7, 2002, Plaintiff's Supplemental Response to Motion for Summary Judgment (Dkt. Entry 61).

Jun. 7, 2002, Defendant's First Set of Requests for Production of Documents and Things to Plaintiff.

Jul. 9, 2002, Plaintiff Kothmann Enterprises, Inc.'s Objections and Responses to Defendant Trinity Industries, Inc.'s First Set of Requests for Production of Documents and Things.

Sep. 20, 2002, Findings of Fact and Conclusions of Law Denying KKI's Application for Preliminary Injunction (Dkt. Entry 62).

Nov. 25, 2002, Order [ordering parties to prepare joint proposed scheduling order for remaining issues of case] (Dkt. Entry 63).

Dec. 13, 2002, Notice of Filing of Joint Proposed Scheduling and Docket Control Order (Dkt. Entry 64).

Jan. 14, 2003, Plaintiff's First Amended Complaint (Dkt. Entry 65).

Jan. 28, 2003, Scheduling and Docket Control Order (Dkt. Entry 66).

Jan. 29, 2003, Defendant Trinity Industries, Inc.'s Unopposed Motion to Extend Time to Answer or Otherwise Respond (Dkt. Entry 67).

Jan. 31, 2003, Order (granting Trinity's Motion to Extend Time) (Dkt. Entry 68).

Feb. 13, 2003, Trinity Industries' Answer to Plaintiff's First Amended Complaint and First Amended Counterclaims (Dkt. Entry 69).

Mar. 28, 2003, Plaintiff Kothmann Enterprises, Inc.'s Second Set of Interrogatories to Defendant Trinity Industries, Inc.

Mar. 31, 2003, Plaintiff Kothmann Enterprises, Inc.'s First Set of Requests for Admission (Nos. 1–121).

Apr. 3, 2003, Plaintiff Kothmann Enterprises, Inc.'s Reply to Defendant Trinity Industries, Inc.'s First Amended Counterclaims (Dkt. Entry 70).

Apr. 28, 2003, Defendant's Second Set of Requests for Production of Documents and Things to Plaintiff.

Apr. 28, 2003, Trinity Industries, Inc.'s Second Set of Interrogatories to Kothmann Enterprises, Inc.

Apr. 28, 2003, Defendant Trinity Industries, Inc.'s Responses to Plaintiff Kothmann Enterprises, Inc.'s Second Set of Interrogatories.

Apr. 30, 2003, Defendant Trinity Industries, Inc.'s Responses to Plaintiff Kothmann Enterprises, Inc.'First Set of Requests for Admission (Nos. 1–121).

May 2, 2003, Joint Claim Construction and Prehearing Statement (Dkt. Entry 71).

May 22, 2003, Joint Motion to Modify Scheduling and Docket Control Order (Dkt. Entry 72).

May 23, 2003, Order [granting Motion to Modify Scheduling and Docket Control Order] (Dkt. Entry 73).

May 29, 2003, Plaintiff Kothmann Enterprises, Inc.'s Second Request for the Production of Documents to Defendant Trinity Industries, Inc.

May 30, 2003, Plaintiff Kothmann Enterprises Inc.'s Objections and Responses to Defendant Trinity Industries, Inc.'s Second Set of Requests for Production of Documents and Things.

Jun. 2, 2003, Plaintiff Kothmann Enterprises, Inc.'s Answers and Objections to Defendant Trinity Industries, Inc.'s Second Set of Interrogatories Nos. 16, 17.
Jun. 28, 2003, Defendant Trinity Industries, Inc.'s Objections and Responses to Plaintiff Kothmann Enterprises, Inc.'s Second Request for Production of Documents.
Jun. 28, 2003, Trinity Industries, Inc.'s Third Set of Interrogatories to Kothmann Enterprises, Inc.
Jul. 2, 2003, Defendant Trinity Industries, Inc.'s Supplemental Responses to Plaintiff's First Set of Interrogatories (Nos. 1,2,7 and 8) and Plaintiff's Second Set of Interrogatories (No. 2).
Jul, 2, 2003, Defendant Trinity Industries, Inc.'s Second Supplemental Responses to Plaintiff's First Set of Interrogatories (Nos. 1,2,7 and 8 ) and Plaintiff's Second Set of Interrogatories (No. 2).
Jul. 3, 2003, Trinity Industries, Inc.'s Notice of Deposition of Dr. Paul F. Packman.
Jul. 9, 2003, Second Amended Counterclaim (Dkt. Entry 74).
Jul. 11, 2003, Plaintiff's Claim Construction Opening Brief (Dkt. Entry 75).
Jul. 11, 2003, Defendant's Claim Construction Opening Brief (Dkt. Entry 76).
Jul. 11, 2003, Appendix by Trinity Industries (Dkt. Entry 77).
Jul. 15, 2003, Plaintiff Kothmann Enterprises, Inc's Supplemental Answers and Objections to Defendant Trinity Industries, Inc.'s First Set of Interrogatories.
Jul. 21, 2003, Trinity Industries, Inc.'s Motion to Strike, Or In the Alternative, For Leave to Increase The Page Limit for Its Response Brief (Dkt. Entry 78).
Jul. 25, 2003, Plaintiff Kothmann Enterprises, Inc.'s Motion for Enlargement of Page Limits for its Opening Markman Brief and Response in Partial Opposition to Defendant Trinity Industries, Inc.'s Motion to Strike, or in the Alternative, for Leave to Increase the Page Limit for its Response Brief (Dkt. Entry 79).
Jul. 30, 2003, Order Denying Trinity's Motion to Strike Kothmann's Claim Construction Brief (Dkt. Entry 80).
Jul. 30, 2003, Defendant Trinity Industries, Inc.'s Claim Construction Response Brief (Dkt. Entry 81).
Jul. 30, 2003, Plaintiff Kothmann Enterprises, Inc.'s Claim Construction Response Brief (Dkt. Entry 82).
Jul. 31, 2003, Defendant Trinity Industries, Inc.'s Objections and Responses to Plaintiff Kothmann Enterprises, Inc.'s Third Request for Production of Documents.
Jul. 31, 2003, Defendant Trinity Industries, Inc.'s Responses to Plaintiff Kothmann Enterprises, Inc.'s Third Set of Interrogatories.
Aug. 5, 2003, Defendant Trinity Industries, Inc.'s Objections and Responses to Plaintiff Kothmann Enterprises, Inc's Fourth Request for Production of Documents.
Aug. 5, 2003, Trinity Industries, Inc.'s Fourth Set of Interrogatories to Kothmann Enterprises, Inc.
Aug. 6, 2003, Defendant's Third Set of Requests for Production of Documents and Things to Plaintiff.
Aug. 6, 2003, Plaintiff Kothmann Enterprises, Inc.'s Reply to Defendant Trinity Industries, Inc.'s Second Amended Counterclaims (Dkt. Entry 83).
Aug. 7, 2003, Defendant Trinity Industries, Inc.'s First Set of Requests for Admission to Plaintiff.
Aug. 11, 2003, Trinity Industries, Inc.'s Notice of Issuance of Subpoena to Brian G. Pfeifer.
Aug. 11, 2003, Defendant Trinity Industries, Inc.'s Notice of Deposition of Plaintiff Kothmann Enterprises, Inc. Under Rule 30(b)(6).
Aug. 13, 2003, Defendant Trinity Industries, Inc.'s Claim Construction Reply Brief (Dkt. Entry 84).
Aug. 20, 2003, Minute Entry (re–setting Markman Hearing) (Dkt. Entry 85).
Aug. 25, 2003, Plaintiff Kothmann Enterprises, Inc.'s Cross–Notice of Deposition of Brian G. Pfeifer.
Aug. 25, 2003, Defendant's Witness List for Claim Construction Hearing (Dkt. Entry 86).
Aug. 25, 2003, Minute Entry –Markman Hearing held (Dkt. Entry 87).
Aug. 25, 2003, Exhibit List of Kothmann Enterprises (Dkt. Entry 88).
Aug. 25, 2003, Exhibit List of Trinity Industries, Inc. (Dkt. Entry 89).
Aug. 25, 2003, Transcript of Markman Hearing (Dkt. Entry 92).
Sep. 2, 2003, Order [re *Markman* Hearing ] (Dkt. Entry 90).
Sep. 8, 2003, Plaintiff Kothmann Enterprises, Inc.'s Answers and Objections to Defendant Trinity Industries, Inc.'s Fourth Set of Interrogatories.
Sep. 8, 2003, Plaintiff Kothmann Enterprises, Inc.'s Answers and Objections to Defendant Trinity Industries, Inc. 's Third Set of Requests for Production.
Sep. 9, 2003, Plaintiff Kothmann Enterprises, Inc.'s Answers and Objections to Defendant Trinity Industries, Inc.'s First of Requests for Admission.
Sep. 16, 2003, Plaintiff Kothmann Enterprises, Inc.'s Answers to Defendant Trinity Industries, Inc.'s Third Set of Interrogatories.
Sep. 16, 2003, Correspondence; Supplemental to KEI's Responses to Trinity's $1^{st}$, $2^{nd}$ & $3^{rd}$ Sets of Interrogatories and KEI's Responses to Trinity's $1^{st}$ Set of Requests for Production.
Sep. 24, 2003, Notice of Filing Joint, Proposed Amended Scheduling and Docket Control Order (Dkt. Entry 91).
Oct. 22, 2003, Amended Scheduling and Docket Control Order (Dkt. Entry 93).
Nov. 12, 2003, Joint Status Report on Mediation (Dkt. Entry 94).
Nov.20, 2003, Receipt for Withdrawal of Exhibits (Dkt. Entry 95).
Dec. 1, 2003, Trinity Industries, Inc.'s Motion to Disqualify Counsel (Dkt. Entry 96).
Dec. 1, 2003, Brief by Trinity Industries, Inc. in Support of Motion to Disqualify Counsel (Dkt. Entry 97).
Dec. 1, 2003, Appendix by Trinity Industries, Inc. in Support of Motion to Disqualify Counsel (Dkt. Entry 98).
Dec. 5, 2003, Minute Entry (Dkt. Entry 99).
Dec. 16, 2003, Transcript of Proceedings of Discovery Hearing (Dkt. Entry 100).
Dec. 19, 2003, Kothmann's Supplemental Answers to Interrogatories Nos. 3, 7, 9–12, 16 & 21.
Dec. 22, 2003, Kothmann's Unnopposed Motion for Enlargement of Page Limits.
Dec. 22, 2003, Kothmann's Response In Opposition to Motion to Disqualify Counsel; proposed Order (Dkt. Entry __).
Mar. 6, 2002, Deposition of Kaddo Kothmann (including Exhs. 5–6).
Mar. 13, 2002, Deposition of Dean L. Sicking (including Exhs. 12 [*see C119*] & Exh. 13–18).

Mar. 27, 2002, Deposition of Maurice E. Bronstad (including Exhs. 5, 7, 9 & 17–18).
Mar. 29, 2002, Deposition of Alan H. Gordon (including Exh. 4).
Apr. 1, 2002, Deposition of Michael O. Sutton (including Exhs. 2, 4–5, 7–11, 13–16 & 18).
Apr. 2, 2002, Deposition of Dr. Paul E. Packman (including Exhs. 4–5 & 10).
Jun. 25, 2003, Deposition of Malcolm Ray (including Exhs. 103 & 106).
Jun. 30, 2003, Deposition of Alan H. Gordon (including Exhs. 16 & 19).
Jul. 1, 2003, Depostion of Dean L. Sicking (including Exhs. 25 & 34).
Jul. 2, 2003, Deposition of Michael O. Sutton (including Exhs. 21, 22, 24–30 & 32).
Aug. 29, 2003, Deposition of Brian G. Pfeifer (including Exhs. 4–6 & 11–13).
1993, National Cooperative Highway Research Program Report 350, (Prod. Nos. T00513–699).
2000, Excerpts of Merriam–Webster's Collegiate Dictionary (11th ed. ) (Prod. Nos. T00700–709).
May, 1997, Dissertation —"Development and Simulation of an Energy Absorbing Guardrail Terminal", by Brian G. Pfeifer (May 1997) (Prod. Nos. T00342–512).
Excerpts —Webster's Third New International Dictionary (Prod. Nos. T01910 –1936).
Excerpts —McGraw–Hill Dictionary of Scientific and Technical Terms (Prod. Nos.T01937 –1945).
2002, Roadside Design Guide 2002 (Prod. Nos. T01946–1949).
1997, "Guardrail and Median Crashworthiness", Synthesis of Highway Practice 244, by Malcolm Ray, et al. (1997) (Prod. Nos. T02850–2853).
Sep. 1994, "Development of Metal Cutting W–Beam Guardrail Terminal", by Pfiefer, et al., Transportation Research Report TRP–03–43–94 (Sep. 1994) (Prod. Nos. T02854–2908).
1996, "Current Research on Roadside Safety Features", Transportation Research Record No. 1528 (1996) (Prod. Nos. T02909–2919).
Nov. 1995, "Development of a Metal Guardrail Terminal", by Pfiefer, et al., Transportation Research Board (Nov. 1995) (Prod. Nos. T02920–2952).
Oct. 24, 1997, "NCHRP Report 350 Compliance Testing of the BEST System", by Pfiefer, et al., Transportation Research Board (Oct. 1997 (Prod. Nos. T02953–2979).
Product brochure —SYRO CAT–350 Crash Cushion (Prod. Nos. T02980–2997).
Installation instructions for CAT 350 (Prod. Nos. T02998–3005).
1993, Excerpts from Webster's Third New International Dictionary (1993) (Prod. Nos. T03006–3039).
Mobile Protection System Product Manual, An NCHRP Report 350–TL#Truck Mounted Attenuator (Prod. Nos. T01256–1283); TRACC Installation Report Manual (T01284–1323); TRACC Design Manual (T01324–1355).
Dec. 31, 2001, Trinity Industries, Inc. Annual Report (Apr. 1, 2001 –Dec. 31, 2001) (T3419 –3481).
2001, Trinity Industries, Inc. Annual Report (2001) (T3482–3533).
2000, Trinity Industries, Inc. Annual Report (2000) (T3534 –3573).
Trinity Industries, Inc. advertising for TRACC and MPS–350 products (T6484–6495).
RSI Brochure —"Performance Makes The Difference" (KEI 000038–43).
May 11, 1995, Letter from Dept. of Transportation to Sicking (KEI000095).
Jan. 3, 1995, Letter from Dept. of Transportation to Pfeifer (KEI000096).
Nov. 15, 2000, Recordation Form Cover Sheet and Assignment from ISC to Kothmann & Kothmann (KEI000097–104).
Feb. 22, 2002, Letter from Dept. of Transportation to Kothmann (KEI000115–122).
Aug. 22, 2001, Letter from RSI/Kothmann to Fed. Hwy. Admin. (KEI000123–124).
Sep. 2000, Safety By Design Schematics (KEI000125–138).
Nov. 16, 1998, Corresondence between Kothmann and Univ. of Nebraska re: development of BEST Terminal (KEI000139–143).
Letter from TX Dept. of Trans. re approval of BEST Terminal (KEI000156–160).
Mar. 10, 1995, Fax Cover Sheet from Univ. of Nebraska to Kothmann (KEI000161).
TX Dept. of Trans. Schematics (KEI000152–164).
Apr. 18, 1995, License Agreement between Univ. of Nebraska & ISC (KEI000165–176).
Schematics –BEST System (KEI000225–232).
Jul. 13, 1995, Correspondence between Kothmann & Univ. of Nebraska (KEI000233–241).
Aug. 5, 1994, Schematics for Metal Cutter —Univ. of Nebraska (KEI000242–243).
Nov. 10, 1994, Letter from Dept. of Transportation to Univ. of Nebraska. re: summary of certification test (KEI000244–302).
Schematics for BEST —Univ. of Nebraska (KEI000303–318).
Jul. 13, 1995, Letter from Univ. of Nebraska to Fed. Hwy. Admin. (KEI000319–325).
Aug. 22, 1995, Letter from Fed. Hwy. Admin, to Univ. of Nebraska re: changes in terminal (KEI000326–331).
Aug. 1994, "Developmentof a Metal Cutting W–Beam Guardrail Terminal", by Pfeifer, et al., Transportation Research Report TRP–03–43–94 (August 1994) (KEI000332–388).
Dec. 4, 1996, "NCHRP Report 350 Compliance Testing of the BEST System", by Pfeifer, et al., Transportation Research Report TRP–03–63–96 (Dec. 1996) KEI000390–548).
Additional papers filed/served in re Kothmann & Kothmann v. Trinity Industries, Inc., No. (S.D. Texas) (see attached list).
Dec, 11, 2003, Notice of Issuance of Subpoena to Vincent L. Carney.
Dec. 19, 2003, Notice of Deposition of Henry L. Ehrlich.
Dec. 23, 2004, Order (resetting expert report deadlines) (Dkt. Entry 103).
Dec. 29, 2003, Order (granting Plaintiff's Motion to Enlarge Time) (Dkt. Entry 104).
Dec. 30, 2003, Plaintiff's Third Set of Interrogatories to Trinity Industries, Inc.
Jan. 7, 2004, Trinity Industries, Inc.'s Supplemental Responses to KEI's First Set of Interrogatories Nos. 1,2 & 5.

Jan. 7, 2004, Trinity Industries, Inc.'s Supplemetal Responses to KEI's Second Set of Interrogatories (Nos. 2–7).
Jan. 8, 2004, Evaluation of Trinity Industries' TRACC and MPS–350 Products Relative to Subject Matter Covered BY U.S. Patents 6,022,003 (Guardrail Cutting Terminal) and 6,505,820 (Guardrail Terminal), by Dean L. Sicking.
Jan. 9, 2004, Defendant Trinity Industries, Inc.'s Designation of Experts (Ray & Sutton) (Dkt. Entry 105).
Jan. 14, 2004, Third Expert Report of Alan H. Gordon.
Jan. 15, 2004, Defendant's Reply in Support of Motion to Disqualify Counsel (Dkt. Entry 106).
Jan. 15, 2004, Defendant's Appendix in Support of Its Reply in Suuport of its Motion to Disqualify Counsel (Dkt. Entry 107).
Jan. 16, 2004, Expert Report of Malcolm H. Ray, Ph.D, P.E.
Jan. 16, 2004, Expert Report of Michael O. Sutton.
Jan. 16, 2004, Expert Report of David N. Fuller, CFR.
Jan. 22, 2004, Minute Entry (Dkt. Entry 108).
Jan. 23, 2004, Order (regarding Kothmann Enterprises Violation of Agreed Protective Order) (Dkt Entry 109).
Jan. 29, 2004, Transcript of Proceedings of telephone Conference with Judge Rosenthal (Dkt. Entry 110).
Feb. 7, 2004, Defendant Trinity Industries, Inc.'s Response to Plaintiff Kothmann Enterprises, Inc.'Second Set of Requests for Admission (Nos. 122–129).
Feb. 9, 2004, Defendant Trinity Industries, Inc.'s Objections and Responses to Plaintiff Kothmann Enterprises, Inc.'s Fifth Request for Production of Documents.
Feb. 9, 2004, Defendant Trinity Industries, Inc.'Responses to Plaintiff Kothmann Enterprises, Inc.'s [Fifth]Set of Interrogatories.
Feb. 10, 2004, Order for Hearing (re Plaintiff's request for discovery conference) (Dkt. Entry 111).
Feb. 12, 2004, Notice of Deposition of KEI.
Feb. 12, 2004, Supplemental Response by Kothmann Enterprises. Inc. in Opposition to Motion to Disqualify Counsel (Dkt. Entry 112).
Feb. 16, 2004, Trinity Industries, Inc.'s Supplemental Responses to Plantiff's Second Set of Interrogatories (No. 4) (Restricted Confidential).
Feb. 16, 2004, Trinity Industries, Inc.'s Supplemental Responses to Kothmann Enterprises, Inc.'s First Set of Interrogatories (No. 3) (Restricted Confidential).
Feb. 17, 2004, Minute Entry: Re discovery conference (Dkt. Entry 113).
Feb. 18, 2004, Plaintiff KEI's Objections to Trinity's Rule 30(b)(6) Notice of Deposition of KEI.
Mar. 1, 2004, Transcript of Proceedings of Discovery Hearing (held Feb. 17, 2004) (Dkt. Entry 114).
Mar. 3, 2004, Return of Service of Subpoena to James Albritton (Dkt. Entry 115).
Jan. 5, 2004, Deposition of Vincent Carney (including exhibits 5–8, 11–13 & 16–17).
Jan. 7, 2004, Deposition of Henry L. Ehrlich.
CD ROM containing Crash Test Data (Feb, 22, 2000) (KEI 00001).
Jan. 13, 2004, Letter from Fed. Hwy Admin. To Trinity re changes to TRACC (KEI 5000–5005).
Jan. 13, 1997Agenda —TRB Committee A2A04 Roadside Safety Features (T06611).
Mar. 12, 2004, Minute Entry: Re discovery conference (Dkt. Entry 116).
Mar. 23, 2004 Response by Kothmann Enterprises, Inc. in opposition to Trinity's oral motion for bifurcation of discovery and trial (Dkt. Entry 118).
Mar. 23, 2004, Order granting Kothmann Enterprises, Inc.'s motion for entry of agreed order arising from the hearing held Feb. 27, 2004, to set scheduling deadlines. (Dkt. Entry 120).
Mar. 23, 2004, Order following Mar. 12, 2004 discovery conference (Dkt. Entry 121).
Mar. 29, 2004, Minute Entry Order: Re discovery conference held (Dkt. Entry 123).
Apr. 9, 2004, Minute Entry Re: discovery conference held (Dkt. Entry 125).
Apr. 14, 2004, Defendant's Supplemental Designation of Expert Witnesses, by Trinity Industries, Inc. (Dkt. Entry 126).
Apr. 14, 2004, Notice of attorney appearance for Trinity Industries, Inc. (deft), Trinity Industries, Inc. (counter–claimant) by Thomas Michael Wall (Dkt. Entry 127).
Apr. 19, 2004, Requested Briefing on Trinity's claim that communications with its expert, James Albritton, are privileged, by Trinity Industries, Inc. (Dkt. Entry 128).
Apr. 26, 2004, Minute Entry Re: status conference held (Dkt. Entry 131).
Apr. 30, 2004, Memorandum Opinion denying Trinity's motion to disqualify counsel (Dkt. Entry 132).
May 6, 2004, Amended supplemental designation of expert witness list by Trinity Industries, Inc. (DKt. Entry 133).
May 4, 2004, Motion to bifurcate Trinity's equitable defenses by Kothmann Enterprises, Inc. (Dkt. Entry 134).
May 17, 2004, Motion for partial summary judgment on Deft Trinity Industries, Inc.' standing defense, by Kothmann Enterprises, Inc. (Dkt. Entry 135).
May 21, 2004, Minute Entry: Re status conference held (Dkt. Entry 136).
May 28, 2004, Motion for partial summary judgment on Deft Trinity Industries, Inc.'s laches and estoppel defenses, by Kothmann Enterprises, Inc. (Dkt. Entry 138).
Jun. 1, 2004, Unopposed motion for leave to exceed the page limits for briefs by Kothmann Enterprises, Inc. (Dkt. Entry 139).
Jun. 1, 2004, Motion for partial summary judgment of infringement regarding claims 3, 4, 11 and 14 of the '820 patent, by Kothmann Enterprises, Inc. (Dkt. Entry 140).
Jun. 1, 2004, Motion for partial summary judgment on deft Trinity Industries, Inc. prosecution laches defense, by Kothmann Enterprises, Inc. (Dkt. Entry 141).
Jun. 1, 2004, Motion for summary judgment on non–infringement, by Trinity Industries, Inc. (Dkt. Entry 142).
Jun. 1, 2004, Appendix by Trinity Industries, Inc. to the motion for summary judgment on non–infringement (Dkt. Entry 143).
Jun. 1, 2004, Unopposed motion for leave to exceed page limit, by Trinity Industries, Inc. (Dkt. Entry 144).
Jun. 1, 2004, Motion for summary judgment of invalidity, by Trinity Industries, Inc. (Dkt. Entry 145).
Jun. 1, 2004, Appendix by Trinity Industries, Inc. to its motion for summary judgment of invalidity (Dkt. Entry 146).
Jun. 1, 2004, Motion for summary judgment, or alternatively, separate trial on inequitable conduct and prosecution laches, by Trinity Industries, Inc..(Dkt. Entry 147).

Jun. 1, 2004, Appendix by Trinity Industries, Inc. to the motion for summary judgement, motion for separate trial on inequitable conduct and prosecution laches (Dkt. Entry 148).
Jun. 3, 2004, Response by Trinity Industries, Inc. to Kothmann's motion to bifurcate Trinity's equitable defenses (Dkt. Entry 150).
Jun. 4, 2004, Order entered: A status conference is rescheduled for 4:00 Jun. 25, 2004 (Dkt. Entry 149).
Jun. 7, 2004, Order granting Kothmann's motion for leave to exceed the page limits for briefs (Dkt. Entry 152).
Jun. 7, 2004, Order granting Trinity Industries, Inc.' motion for leave to exceed page limit (Dkt. Entry 153).
Jun. 14, 2004, Trinity Industries, Inc.'s unopposed motion for leave to file a supplemental memorandum in support of its motion for summary judgment of non–infringement (Dkt. Entry 156).
Jun. 14, 2004, Supplemental memorandum by Trinity Industries, Inc. in support of defendant's motion for summary judgment on non–infringement (Dkt. Entry 157).
Jun. 14, 2004, Motion to exclude certain expert testimony by Michael O. Sutton by Kothmann Enterprises, Inc. (Dkt. Entry 159).
Jun. 21, 2004, Unopposed motion for leave to exceed the page limits for briefs, by Kothmann Enterprises, Inc. (Dkt. Entry 161).
Jun. 21, 2004, Response by Kothmann Enterprises, Inc. in opposition to Defendant Trinity Industries, Inc.'s motion for summary judgment, motion for separate trial on inequitable conduct and prosecution laches (Dkt. Entry 162).
Jun. 21, 2004, Response by Kothmann Enterprises, Inc. in opposition to Defendant Trinity Industries, Inc.'s motion for summary judgment on non–infringement (Dkt. Entry 163).
Jun. 21, 2004, Response by Kothmann Enterprises, Inc. in opposition to Defendant Trinity Industries, Inc.'s motion for summary judgment of invalidity (Dkt. Entry 164).
Jun. 21, 2004, Order granting Trinity Industries, Inc.'s motion for leave to file a supplemental memorandum in support of its motion for summary judgment of non–infringement (Dkt. Entry 165).
Jun. 21, 2004, Order granting Kothmann Enterprises, Inc.'s motion for leave to exceed the page limits for brief (Dkt. Entry 170).
Jul. 6, 2004, Response by Trinity Industries, Inc. in opposition to plaintiff's motion to exclude certain expert testimony by Michael O. Sutton (Dkt. Entry 172).
Jul. 6, 2004, Appendix by Trinity Industries, Inc. to the response in opposition to plaintiffs motion to exclude certain testimony of Michael Sutton (Dkt. Entry 173).
Jul. 15, 2004, Reply by Trinity Industries, Inc. in support of its motion for summary judgment of invalidity (Dkt. Entry 175).
Jul. 15, 2004, Reply by Trinity Industries, Inc. in support of its motion for summary judgment, motion separate trial on inequitable conduct and prosecution laches (Dkt. Entry 176).
Jul. 15, 2004, Memorandum in response by Kothmann Enterprises, Inc. to Defendant's supplemental memorandum in support of its motion for summary judgment of non–infringement (Dkt. Entry 177).
Jul. 16, 2004, Reply by Trinity Industries, Inc. in support of its motion for summary judgment on non–infringement (Dkt. Entry 178).
Jul. 27, 2004, Order granting Trinity Industries, Inc.'s motion for leave to file reply briefs (Dkt. Entry 179).
Jul. 28, 2004, Notice pursuant to 35 USC 282, by Trinity Industries, Inc. (Dkt. Entry 180).
Aug. 2, 2004, Surresponse by Kothmann Enterprises, Inc. in opposition to defendant Trinity Industries, Inc.'s motion for summary judgment on inequitable conduct and prosecution laches, and Statement of no opposition to its motion separate trials on inequitable conduct and prosecution laches (Dkt. Entry 181).
Aug. 11, 2004, Order granting the joint motion to move docket call and pre–trial order deadline. . .set for Oct. 22, 2004, (Dkt. Entry 183).
Oct. 8, 2004, Expedited motion to extend deadline for pretrial submissions and docket call, by Trinity Industries, Inc.(Dkt. Entry 185).
Oct. 12, 2004, Notice of Setting: status conference set for Oct. 21, 2004, at 10:00 a.m. in courtroom 11B before Judge Lee H. Rosenthal (Dkt. Entry 184).
Nov. 23, 2004, Order: the new deadline for filing the joint pretrial order is Jan. 14, 2005, (Dkt. Entry 188).
Dec. 17, 2004, Notice of Availability for Inspection, by Trinity Industries, Inc. (Dkt. Enrty 190).
Dec. 17, 2004, Minute Entry: Re proceedings held before Judge Lee H. Rosenthal (Dkt. Entry 191).
Jan. 3, 2005, Opposed motion for leave to file surresponse in opposition to defendant Trinity Industries, Inc.'s motion for summary judgment of inequitable conduct and prosecution laches, and surresponse in opposition to defendant's motion for summary judgment of invalidity, by Kothmann Enterprises, Inc. (Dkt. Entry 193).
Jan. 3, 2005, Surresponse in opposition to motion for summary judgment, by Kothmann Enterprises, Inc. with attachments (Dkt. Entry 194).
Jan. 3, 2005, Second Surrepsonse in opposition to motion for summary judgment, by Kothmann Enterprises, Inc. (Dkt. Entry 195).
Jan. 3, 2005, Statement by Trinity Industries, Inc. (Dkt. Entry 196).
Jan. 3, 2005, Motion to continue trial deadlines, expedited motion, by Trinity Industries, Inc. (Dkt. Entry 197).
Jan. 12, 2005, Order entered: plaintiff's opposed motion for leave to file surresponse in opposition to defendant's motion for summary judgment of inequitable conduct and prosecution laches, and surresponse in opposition to defendant's motion for summary judgment of invalidy is granted; defendant's motion to continue trial deadlines expedited motion is granted (Dkt. Entry 198).
Feb. 2, 2005, Motion to compel supplemental discovery and for leave to take additional discovery regarding plaintiff's new patent, expedited by Trinity Industries, Inc. (Dkt. Entry 199).*
Feb. 2, 2005, Notice of Setting as to motion to compel supplemental discovery and for leave to take additional discovery regarding plaintiff's new patent, expedited motion hearing set for Feb. 7, 2005 at 10:00 a.m. in courtroom 11B before Judge Lee H. Rosenthal (Dkt. Entry 200).*
Feb. 4, 2005, Motion for extension of time to file supplemental briefs, by Trinity Industries, Inc. (Dkt. Entry 201).*
Feb. 5, 2005, Response to motion to compel supplemental discovery and for leave to take additional discovery regarding plaintiff's new patent, expedited, by Kothmann Enterprises, Inc. (Dkt. Entry 202).*
Mar. 11, 2005, Reply to response to motion for summary judgment, by Trinity Industries, Inc. (Dkt. Entry 205).*

Mar. 29, 2005, Memorandum and opinion entered denying plaintiff's motion to exclude, granting in part and denying in part defendant's sealed motion, motions terminated: sealed motion, motion to exclude (Dkt. Entry 206).*

Mar. 30, 2005, Memorandum and Order denying as moot motion to bifurcate, denying motion for partial summary judgment, denying motion for partial summary judgment, denying motion for summary judgment, granting motion for separate bench trial on the equitable defenses (Dkt. Entry 207).*

Apr. 8, 2005, Order: This order is in response to the Apr. 8, 2005 letter submitted by Trinity Industries, Inc. and the response by Kothmann Enterprises, Inc. concerning the scope of the pretial submissions due Apr. 22, 2005, (Dkt. Entry 208).

Apr. 11, 2005, Supplemental Notice Pursuant to 35USC 282, by Trinity Industries, Inc. (Dkt. Entry 209).

Apr. 12, 2005, Order in response to the Apr. 12, 2005 letter submitted by counsel for plaintiff (Dkt. Entry 211).

Apr. 12, 2005, Order in response to plaintiff's letter of Apr. 12, 2005 (Dkt. Entry 212).

Apr. 21, 2005, Notice of Resetting as to scheduling order. . . terminate motions (Dkt. Entry 213).

Apr. 25, 2005, Motion in limine to exclude the supplemental report of Michael Sutton and testimony related thereto at the bench trial, by Kothmann Enterprises, Inc. (Dkt. Entry 214).

Apr. 25, 2005, Motion in limine to exclude late noticed patents and testimony thereon, by Kothmann Enterprises, Inc. (Dkt. Entry 217).

Apr. 26, 2005, Proposed petrial order, by Trinity Industries, Inc. (Dkt. Entries 215 and 216).

May, 6, 2005, Amended motion in limine to exclude late noticed patents and testimony thereon, by Kothmann Enterprises, Inc. (Dkt. Entry 219).

May 6, 2005, Bench memo on judicial admissions, by Kothmann Enterprises, Inc. (Dkt. Entry 220).

May 6, 2005, Motion in limine to exclude certain testimony of Dr. Malcolm Ray at the bench trial, by Kothmann Enterprises, Inc. (Dkt. Entry 222).

May 6, 2005, Response to objection to plaintiff's proposed Exhibit 11, by Kothmann Enterprises, Inc. (Dkt. Entry 223).

May 11, 2005, Exhibit list by Trinity Industries, Inc. (Dkt. Entry 227).

May 11, 2005, Exhibit list by Kothmann Enterprises, Inc. (Dkt. Entry 228).

May 17, 2005, Transcript of vol. 1 —bench trial held on May 9, 2005 before Judge Lee Rosenthal (Dkt. Entry 229).

May 17, 2005, Transcript of vol. 2 —bench trial held on May 10, 2005 before Judge Lee Rosenthal (Dkt. Entry 230).

May 17, 2005, Transcript of vol. 3 —bench trial held on May 11, 2005 before Judge Lee Rosenthal (Dkt. Entry 231).

May 19, 2005, Motion for clarification of order on plaintiff's exhibit list, by Kothmann Enterprises, Inc. (Dkt. Entry 232).

May 24, 2005, Commissioner of patents and trademarks, AO–120, notified (Dkt. Entry 233).

May 31, 2005, Proposed findings of fact, by Trinity Industries, Inc.(Dkt. Entry 234).

May 31, 2005, Unopposed motion for leave to file excess pages, by Trinity Industries, Inc. (Dkt. Entry 235).

Jun. 1, 2005, Order granting motion for leave to file excess pages (Dkt. Entry 236).

Jun. 8, 2005, Response in opposition to motion for clarification, by Trinity Industries, Inc. (Dkt. Entry 237).

Jun. 10, 2005, Motion for leave to file plaintiff's unopposed motion for leave to exceed page limitation, by Kothmann Enterprises, Inc. (Dkt. Entry 238).

Jun. 10, 2005, Order granting motion for leave to file excess pages (Dkt. Entry 239).

Jun. 14, 2005, Post–Hearing Brief, by Kothmann Enterprises, Inc. (Dkt. Entry 240) (Duplicate of Dkt. Entry 242).

Jun. 14, 2005, Appendix to Post Hearing Brief, by Kothmann Enterprises, Inc. (Dkt. Entry 241).

Jun. 14, 2005, Post–Trial Brief, by Kothmann Enterprises, Inc. (Dkt. Entry 242).

Jun. 20, 2005, Unopposed motion for extension of time for submission of reply brief, by Trinity Industries, Inc. (Dkt. Entry 243).

Jun. 21, 2005, Order granting unopposed motion for extension of time for submission of reply brief (Dkt. Entry 244).

Jun. 23, 2005, Post–Hearing Reply Brief, by Trinity Industries, Inc. (Dkt. Entry 245).

Jun. 23, 2005, Motion to strike trial brief, by Trinity Industries, Inc. (Dkt. Entry 246).

Jun. 29, 2005, Response to motion to strike trial brief, by Kothmann Enterprises, Inc. (Dkt. Entry 247).

Jul. 1, 2005, Post–Trial Sur–reply brief, by Kothmann Enterprises, Inc. (Dkt. Entry 248).

Jul. 11, 2005, Notice of change of address by Charles J. Rogers and Thomas L. Warden, counsel for Kothmann Enterprises, Inc. (Dkt. Entry 249).

Jul. 18, 2005, Notice of Screening Procedure by Kothmann Enterprises, Inc. (Dkt. Entry 250).

Mar. 12, 2004, Rebuttal Expert Report of Alan H. Gordon [as patent practice and procedure expert on behalf of Kothmann Enterprises, Inc.] (not filed).

Apr. 14, 2004, Review of Expert Report Entitled "Expert Report of Malcolm H. Ray, Ph.D., P.E." by Dean L. Sicking, Ph.D., P.E. [as technical expert on behalf of Kothmann Enterprises, Inc.] (not filed).

Apr. 14, 2004, Rebuttal Expert Report of Michael O. Sutton [as patent practice and procedure expert on behalf of Trinity Industries, Inc.] (not filed).

Apr. 14, 2004, Expert Report of Dean C. Alberson [as technical expert on behalf of Trinity Industries, Inc.] (not filed).

Apr. 28, 2004, Review of Expert Report Entitled "Expert Report of Malcolm H. Ray, Ph.D., P.E." by Dean L. Sicking, Ph.D., P.E. [as technical expert on behalf of Kothmann Enterprises, Inc.] (not filed).

Apr. 28, 2004, Expert Report of Michael O. Sutton In Reply to Rebuttal Expert Report of Alan H. Gordon [as patent practice and procedure expert on behalf of Trinity Industries, Inc.] (not filed).

Apr. 28, 2004, Rebuttal Report of Malcolm H. Ray, Ph.D., P.E. [as technical expert on behalf of Trinity Industries, Inc.] (not filed).

May 4, 2004, Transcript of Deposition of Dean L. Sicking, Ph.D., P.E. [as technical expert on behalf of Kothmann Enterprises, Inc.] (not filed).

May. 10, 2004, Transcript of Deposition of Dean C. Alberson, Ph.D., P.E. [as technical expert on behalf of Trinity Industries, Inc.] (not filed).

May 18, 2004, Transcript of Deposition of Malcolm H. Ray, Ph.D., P.E. [as technical expert on behalf of Trinity Industries, Inc.] (not filed).
May 10, 2004, Transcript of Deposition of Michael O. Sutton [as patent practice and procedure expert on behalf of Trinity Industries, Inc.] (not filed).
Apr. 21, 2005, Supplemental Expert Report of Michael O. Sutton [as patent practice and procedure expert on behalf of Trinity Industries, Inc.] (not filed).
Sep. 16, 2005, Plaintiff Kothmann Enterprises, Inc.'s Supplemental Post–Trial Brief on Prosecution Laches (Dkt. Entry 251).

Additional papers filed/served in re: Kothmann & Kothmann v. Trinity Industries, Inc., No. (S.D. Texas) (see attached list).

* cited by examiner

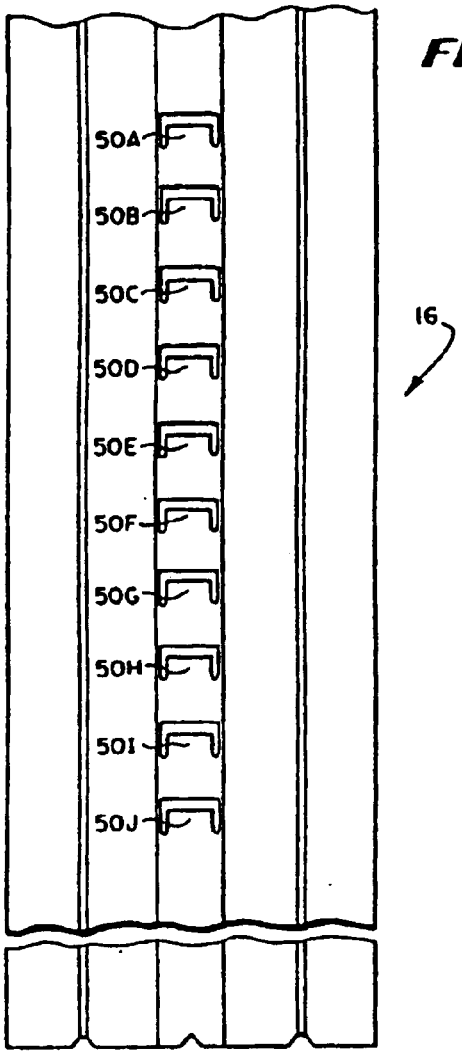
FIG. 13
FIG. 14
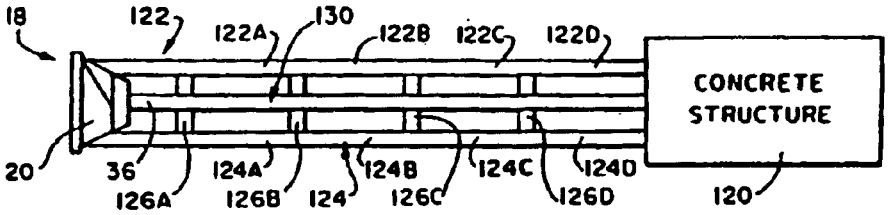

ENERGY-ABSORPTION SYSTEM

REFERENCE TO RELATED APPLICATIONS

This application is a continuation of and claims priority to the filing dare of U.S. patent application Ser. No. 09/410,635, filed an Oct. 1, 1999, for ENERGY ABSORPTION SYSTEM, now U.S. Parent 6,505,820 issued on Jan. 14, 2003, which is a divisional of and claims priority to U.S. patent application Ser. No. 08/335,153, filed on Nov. 7, 1994, for GUARDRAIL CUTTING TERMINAL, now U.S. Pat. No. 6,022,003.

BACKGROUND OF THE INVENTION

This invention relates to guardrails intended to be positioned along a highway to reduce injury to the driver and passenger of vehicles that may accidentally tend to leave the highway.

In one class of guardrail system, each guardrail system includes an elongated barrier and at least one energy-absorbing terminal. The elongated barrier extends parallel to the roadway along the side of the roadway and ends in a terminal. The terminal cooperates with one or more components of the barrier to absorb energy when a vehicle hits the terminal itself.

The terminal is constructed to stop the vehicle without subjecting the occupant to excessive forces and to avoid impaling the passenger compartment of the vehicle or redirecting the vehicle in a dangerous direction or permitting the vehicle to continue in a dangerous direction at a dangerous speed when the vehicle hits the terminal itself. The barrier is designed to redirect the vehicle in a safer direction and impede its progress when the vehicle hits the barrier itself.

The terminals and barrier of the energy-absorbing guardrail are designed so that:

(1) when the vehicle hits the barrier itself, the barrier is anchored by a cable or similar component with tensile strength to support the vehicle from moving excessively in a direction perpendicular to the roadway; and (2) when the vehicle hits the terminal, the cable or other support member is released to avoid pulling the barrier out of its alignment with the terminal which would prevent the movement of the terminal and barrier together to absorb energy.

A prior art guardrail of this class is described in U.S. Pat. Nos. 4,928,928 and 5,078,366 filed in the name of Sicking, et al. This prior art energy-absorbing guardrail has a terminal that extrudes a metal portion of the barrier, which is generally a W-beam rail or the like. In this prior art guardrail, the terminal, upon impact by a vehicle, moves along the rail, forcing the rail into a narrowing chute to extrude the rail and bend it into a roll, thus absorbing energy from metal working the rail. When the terminal is impacted, the cable anchoring the rail is released by the force of the impact.

This type of guardrail has several disadvantages, such as for example: (1) it is relatively expensive; and (2) the basic configuration cannot be readily adapted to different thickness of beam or to different materials from which the barrier may be constructed. Moreover, it is difficult to adapt the basic design to absorb energy at different rates depending on the nature of the roadway along which it is positioned. Thus, the rate of absorbing energy is the same for highways adapted to carry trucks and other vehicles at high speeds as it is for roadways having a lower speed limit and being adapted for smaller vehicles traveling at lower speeds although the highway may call for much more energy absorption per linear foot of travel of the vehicle striking the terminal.

Another prior art energy-absorbing guardrail of this class is disclosed in U.S. Pat. No. 4,655,434 to Bronstad and U.S. Pat. No. 4,838,523 to Walter P. Humble, et al. This prior art guardrail includes two parallel rails with horizontal connecting members between them. The terminal, when hit by a vehicle, moves along the guardrail, hitting the horizontal connecting members as it goes and causing the connecting members to move along a line of perforations in the metal rails, absorbing energy from the metal working as it moves.

This type of guardrail has a disadvantage of being expensive and not adapted for different sizes and speeds of automobiles without special design.

SUMMARY OF THE INVENTION

It is an object of the invention to provide a novel guardrail system.

It is a further object of the invention to provide a novel energy-absorbing terminal for guardrail systems.

It is a still further object of the invention to provide a method and apparatus for absorbing the energy of a vehicle that collides with a guardrail system.

It is a still further object of the invention to provide a method and apparatus for restraining and redirecting vehicles that collide with guardrail systems.

It is a still further object of the invention to provide a method and apparatus for making and using an energy-absorbing guardrail terminal adapted for a particular type of guardrail and an energy-absorbing guardrail terminal that can be inexpensively adapted for different types of guardrails.

It is a still further object of the invention to provide a method of making guardrails adapted for a particular highway and a guardrail which can be inexpensively adapted for the different highways.

It is a still further object of the invention to provide an energy-absorbing guardrail terminal useful with beams of reinforced plastic in a guardrail.

In accordance with the above and further objects of the invention, a guardrail system includes a guardrail and a guardrail terminal arranged so that the terminal cooperates with the guardrail to absorb energy if a vehicle hits the terminal and releases the guardrail upon impact of the vehicle with the terminal but anchors the guardrail if the guardrail is impacted by the vehicle instead of the terminal.

The terminal assembly includes an impact head and a cutting section. When the impact head is hit by a vehicle, it moves the cutting section in a manner to cut the beam of the guardrail and activates an anchor release to release the anchor from the guardrail itself. In the preferred embodiment, the guardrail is released from a cable by breaking the first post which has the cable bolted to it at one end. The other end of the cable is mounted to the guardrail. The post breaks at the cable connection, releasing the cable.

The cutting section includes a tube having one or more cutting members within it and a deflection plate. The cutting member or members are designed to aid the deflection plate in the absorption of energy.

For example, one or more shear type cutters may be located to reduce the moment of inertia of beams and thereby to reduce the total amount of energy absorbed per linear foot of travel for each portion of a beam when a thicker metal guardrail beam is used and thus compensate for the increased energy absorbed because of the thickness of the guardrail and vice versa. Thus, the guardrail system may be designed to accommodate different types and thickness of guardrail beams. Similarly, the energy absorbed for each linear foot of travel may be tailored for the nature of the traffic on the roadway such as to absorb more energy for roadways where the traffic is faster and includes heavier vehicles and to absorb less energy per linear foot for roadways in which the traffic is slower and includes lighter vehicles.

In the case of nonmetallic beams or beams of any other type that absorb energy during fragmenting by buckling, compression failure, breaking and tensile failure against or because of the deflecting plate rather than bending, such as some fiber reinforced plastic beams, cutters aid in centering the beam portions, in causing the fragmenting to take place near the deflection plate to increase the amount of energy to be absorbed and maintaining stability of the operation. For example, the proper angle of a wedge shaped cutter and the proper location of the cutter stabilizes the path of the fragments of the plastic reinforced beams after being cut. The shape and location of the cutters and the shape and location of the deflector plates affect the amount of fragmenting and thereby increase or decrease the energy absorption per foot of travel by increasing the fragmenting or decreasing the amount of fragmenting respectively.

From the above description, it can be understood that the guardrail system of this invention has several advantages, such as: (1) it is relatively inexpensive to fabricate; and (2) it may be easily designed for different rates of energy absorption without modifying the heavy frame structure and only modifying the cutting mechanisms themselves.

SUMMARY OF THE DRAWINGS

The above noted and other features of the invention will be better understood from the following detailed description when considered with reference to the accompanying drawings, in which:

FIG. 13 is an elevational view of a W-rail adapted to receive the anchor of FIGS. 11 and 12;

FIG. 14 is a plan view of a terminal in accordance with an embodiment of the invention used as an energy-absorbing guard for objects near a roadway.

DETAILED DESCRIPTION

Figure 1:
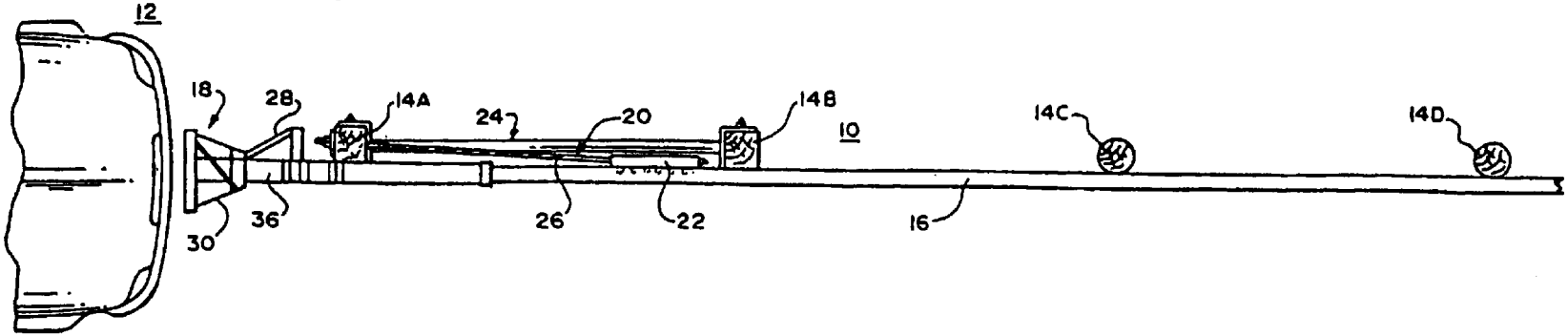
FIG. 1 is a fragmentary plan view of a guardrail system in accordance with an embodiment of the invention.

In FIG. 1, there is shown a plan view of a guardrail system 10 with a vehicle 12 positioned to hit it. The guardrail system 10 includes a plurality of posts, four of which are shown at 14A, 14B, 14C and 14D, a guardrail 16, a terminal assembly 18 and a cable anchoring system 20, with the terminal assembly 18 being at one end of the guardrail 16 and the cable anchoring system connecting the guardrail 16 to a support. The guardrail 16 is mounted to the posts 14A–14D to be substantially parallel to a roadway.

In this guardrail system, the terminal assembly 18 and the guardrail 16 cooperate together to reduce the likelihood of bodily injury to passengers and guests in the vehicle 12 when the vehicle 12 leaves the roadway and impacts against the guardrail 16 or the terminal assembly 18 at its end. The guardrail 16 may be of any suitable type, but in the preferred embodiment, it includes a conventional W-beam. Similarly, the posts 14A, 14B, 14C and 14D may be of any general type but in the preferred embodiment are wood posts which have mounted to their side facing the roadway, the guardrail 16 by bolts or indentations or the like. The terminal assembly 18 is mounted to the guardrail 16 at one end and positioned so that it may move along the guardrail, cutting the guardrail to absorb energy when it is impacted by the vehicle 12.

The terminal assembly 18 includes a post breaking arm 28, an impact head 30 and a cutting section 36. The impact head 30 is a strong wide-mouthed section having its wide portion facing outwardly from the guardrail 16 to receive a vehicle such as 12 and its narrower end connected to one end of the cutting section 36. The post breaking arm 28 is a braced metal member that extends outwardly from the longitudinal axis of the terminal and the guardrail, positioned to hit the post 14A and break it when a vehicle such as 12 pushes the impact head 30 and the cutting section 36 forwardly along the guardrail to cut the guardrail. The guardrail 16 may be severed into partly separated portions or only scored to provide partial grooves, depending on the nature of the cutting section 36.

The cable anchoring system 20 includes an anchor 22 and a cable 26. The anchor 22 has openings along its length which receive tabs formed in the guardrail 16 to be held firmly when the guardrail is impacted at an angle along its length. One end of the cable 26 passes through the anchor 22 and is held by a bolt on one side but extends from the opposite end. The other end of the cable 26 is bolted to the post 14A at its weakest point so that, when the impact head 30 moves under the force of a vehicle 12, the post breaking arm 28 breaks the post 14A at the point where the cable 26 is attached to release the anchor 22 and allow the guardrail 16 to be fed through the cutting section 36. A ground line pipe strut 24 extends between the first two posts to provide a connection that prevents the excessive movement of either post upon impact of a vehicle with the guardrail 16.

Figure 2:
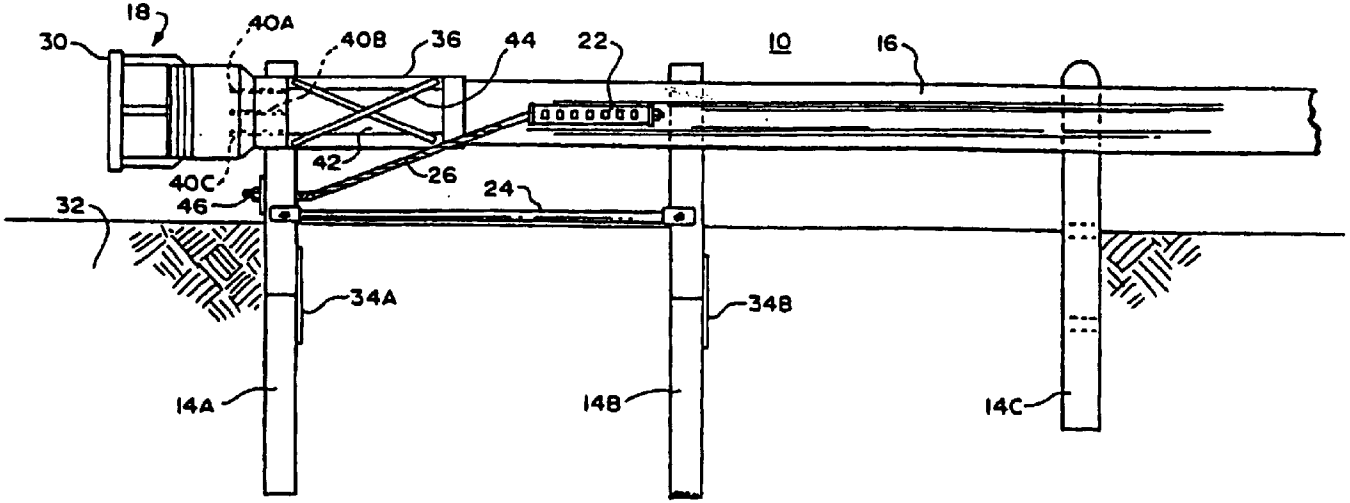
FIG. 2 is a fragmentary side elevational view of the guardrail system of FIG. 1.

In FIG. 2, there is shown a fragmentary elevational view of the guardrail system 10 from the front side of the system or the right side of the road showing the terminal assembly 18 connected to the guardrail 16, which in turn is connected to a plurality of posts, the posts 14A–14C being shown in FIG. 2. The posts are mounted in the ground 32 and the first two posts 14A and 14B are connected to each other by the ground line pipe strut 24 to provide combined resistance to movement.

The cable 26 is connected at one end to the anchor 22 and at its other end, to the post 14A by a bolt 46 passing through the post 14A. Reinforcing members 34A and 34B and the pipe strut 24 between them maintain the posts 14A and 14B in position during impact.

When a vehicle strikes from the front side of the guardrail 16, it moves the guardrail toward the rear, but the guardrail is restrained by the cable 26 and tension to impede movement of the vehicle off the road and redirects the vehicle to some extent back onto the roadway. In this specification, the front side means the side of the guardrail system facing the road. The rear side means the side of the guardrail system facing away from the roadway. The cutting section 36 of the terminal assembly 18 includes a plurality of cutters, three of which are shown at 40A–40C mounted between the impact head 30 and the cutting section 36 and facing the guardrail 16, which may be a W-beam rail. The cutters are positioned to each engage the rail 16 and cut it in three parallel lines along its length as the terminal is moved toward the rail 16.

The cutting section 36 is open, having supports such as support 44 forming a guide that receives the W-beam as the cutting section 36 and impact head 30 are moved with respect to the W-beam 16 so that the W-beam moves into the hollow portion of the cutting section 36 and hits the cutters 40A–40C. These cutters slice the rail 16 with a shearing action in the embodiment of FIG. 2. For standard W-beams positioned along a highway, three shear type cutters as described hereinafter provide an appropriate amount of energy absorbing as the terminal and rail are moved together for cutting.

Figure 3:
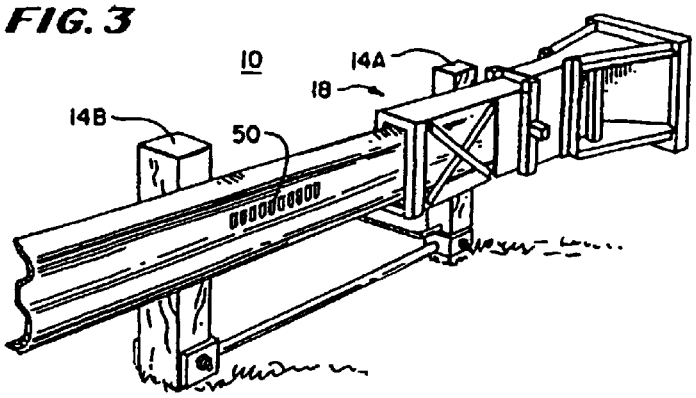
FIG. 3 is a fragmentary perspective view of a portion of a guardrail and terminal assembly showing the top and rear side of the guardrail system in accordance with an embodiment of the invention.
Figure 4:
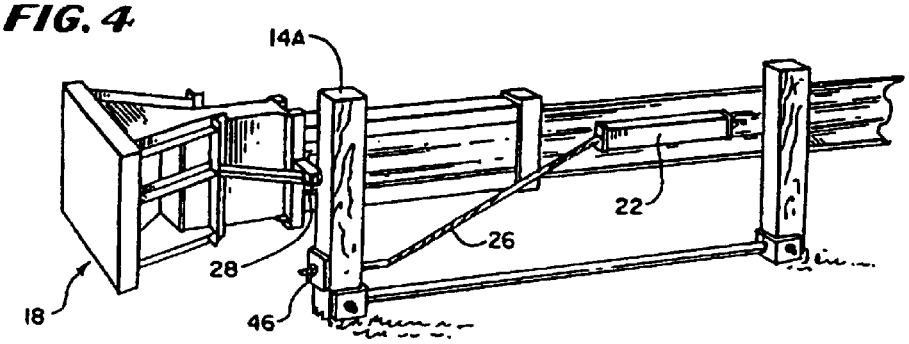
FIG. 4 is another fragmentary perspective view of the terminal and guardrail of FIG. 1 showing the top and front side of the guardrail system.

In FIG. 3, there is shown a fragmentary, perspective view of the top and rear side of the guardrail system 10 illustrating the manner in which tabs 50 from the anchor 22 (FIG. 2) extend through a W-beam of the guardrail system 10 to hold the anchor 22 in place as better shown in FIG. 4. FIG. 4 is a fragmentary, perspective view of the front side of the guardrail system 10 showing the anchor 22 holding one end of the cable 26, with the other end being fastened to the post 14A by the bolt 46. With this arrangement, when a vehicle hits the W-beam, the beam is held by the cable 26 to aid in redirecting the vehicle but when the vehicle hits the terminal 18, the post 14A is broken by the post breaking arm 28 to release the cable 26 so that the guardrail can continue to travel through the energy absorbing terminal.

Figure 5:
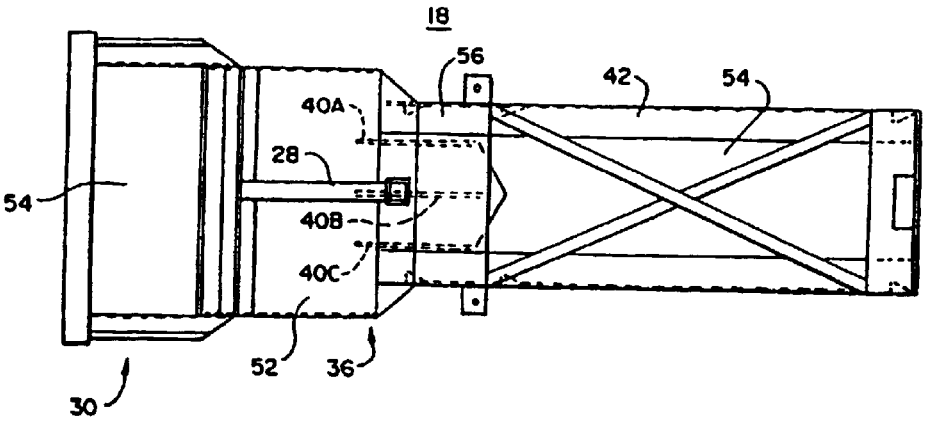
FIG. 5 is an elevational view of an impact head and cutting section of the embodiment of FIG. 1.

In FIG. 5, there is shown a side elevational view of the terminal assembly 18 having a hollow impact head 30 and a cutting section 36. The cutting section 36 includes a cutter holding section 52 and a hollow receiving section 42, each aligned with the other and fastened together so that there is a continuous passageway 54 throughout the interior of the receiving section 42, cutter holding section 52 and the interior of the impact head 30.

The impact head 30 is made of heavy steel in the preferred embodiment but may be made of other materials provided they are sufficiently strong to move the entire terminal with respect to the rail while the rail being cut within the cutting section 36. The impact head 30 is sized: (1) to engage a sufficient area of the vehicle that hits the impact head to avoid penetrating the vehicle body; and (2) to avoid any dimension that would permit the impact head 30 to project sufficiently to block the roadway.

The cutting section 36 includes a square tubular steel frame 56 having the cutters 40A–40C welded within it to be horizontal when the terminal assembly 18 is mounted in place. The cutters may be three steel blades 40A, 40B and 40C, parallel to each other and positioned to be received by the W-beam in a V-shaped notch in the vertically mounted rail to cut the rail. A deflector plate, not shown in FIG. 5, moves the rail to the side to utilize energy in bending.

The passageway 54 is a right regular parallelepiped within the receiving section 42 and is joined by beveled edges to a larger right regular parallelepiped in the blade holding section 56 and from there, to the open section 54 so that relatively straight cuts are made in the rail without absorbing energy by squeezing or extruding the rail.

Figure 6:
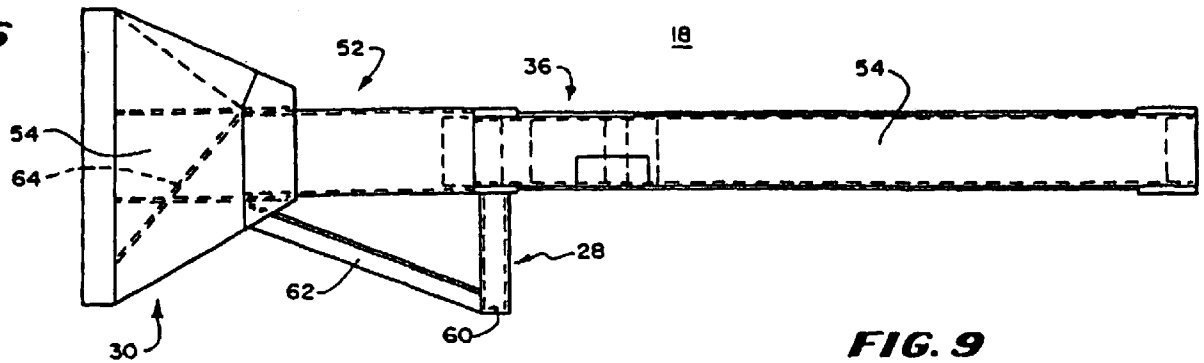
FIG. 6 is a plan view of the impact head and cutting section of FIG. 5.

In FIG. 6, there is shown a plan view of the terminal assembly 18 showing the post breaking arm 28 which is formed preferably of steel tubing having an orthogonally extending tube 60 braced by a diagonal tube 62. The orthogonal extending tube 60 is, in the preferred embodiment, a two inch by two inch by three-sixteenth inch structural tube extending outwardly approximately one foot and the diagonal bracing member 62 is one and one-half inch by one and one-half inch by three-sixteenth inch structural tube welded at one end to the distal end of the extending tube 60 and at its other end to the wall of the terminal 18 closer to the impact head 30 than the outwardly extending post 60. They are positioned to hit the post 14A (FIG. 1) at a location above the bolt and provide sufficient force to break the post.

To bend the cut portions of the guardrail, a deflector plate 64 is mounted at an angle to the longitudinal axis of the passageway 54. With this arrangement, fragments of severed portions of the guardrail beam are bent to the side, absorbing further energy.

Figure 7:
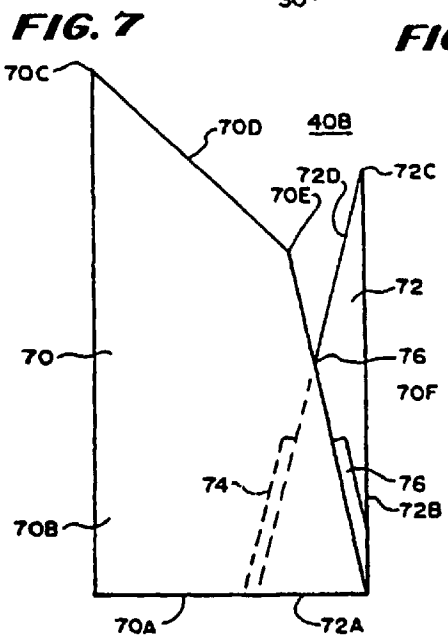
FIG. 7 is an elevational view of one form of cutter in accordance with an embodiment of the invention.

In FIG. 7, there is shown an elevational view of the cutter 40B formed by first and second steel sections 70 and 72 welded together at locations 74 and 76. The first and second steel sections 70 and 72 are each abrasion resistant steel plates dimensioned to be stronger than the W-beam so as to be able to sever it.

The first steel plate 70 has a base edge 70A, which in the preferred embodiment is approximately four and seven-eighth inches long, an upwardly extending side edge 70B which is approximately eight inches high and ends in a point 70C, the side edge 70B forming a right angle with the base edge 70A. A side edge 70D slants downwardly from the peak 70C to a point 70E and then at an angle slants downwardly more steeply along a edge 70F to the other side of the base edge 70A.

The second steel plate 72 has a base edge 72A which ends at the bottom end of the edge 70E for the first plate 70 and extends perpendicularly upwardly along an edge 72B to a point 72C lower than the point 70C. From the point 72C, an edge 72D of the second plate 72 extends downwardly to the base 72A at a sharp angle so that it is spaced from the edge 70E until approximately one-third of the distance to the base 72A. Where the edges 72D and 70E cross at a point 76, an acute angle is formed. The welds 74 and 76 are closer to the bases 70A and 72A to hold the plates together.

The location of the point 76 is positioned to engage the W-beam 16 (FIGS. 1 and 2) when a vehicle such as 12 engages the impact head 30 (FIG. 1) to cut the W-beam 16 at three locations. The cutters 40A, 40B and 40C (FIG. 5) are substantially the same and in FIG. 8, bear the same reference numerals. The cutter blades in the preferred embodiment are three-eighths inch in thickness.

Figure 8:
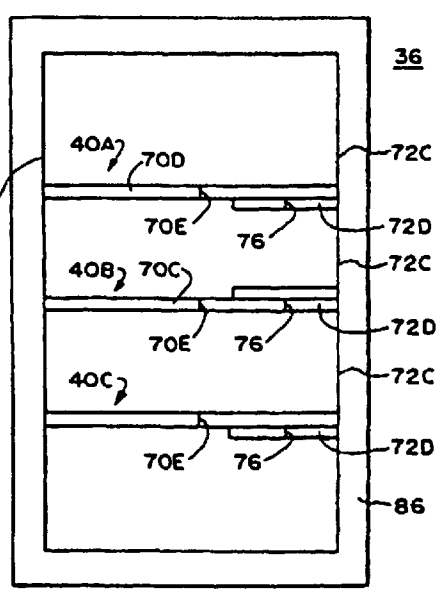
FIG. 8 is a fragmentary end view of a cutting section in accordance with the embodiment of FIG. 1 including the cutters of FIGS. 5, 6 and 7.

In FIG. 8, there is shown an end view of the cutter section 36 showing the cutter blades 40A, 40B and 40C spaced along the cutter section to receive a rail beam at the three points 76 on the three cutters. At these points, the force of the impact of the vehicle causes cutting of the W-beam or other rail member to dissipate energy. The plates 70 and 72 shown in FIG. 7 are located with respect to each other and to adjacent cutters to cause the severed sections of the beam to be deflected in opposite directions. This is done by alternating the location of the plate 72 with respect to the plate 70 with respect to adjacent cutters 40A, 40B and 40C so that the plate 72 is on the top side of the plate 70 for the top cutter 40A to deflect the severed portion of the beam upwardly, the plate 72 is on the bottom side of the plate 70 for the cutter 40B adjacent to the cutter 40A to deflect the severed portion of the beam downwardly and so on.

While three cutters are shown in FIG. 8, any other number may be selected and the spacing between them may be varied to change the amount of energy absorbed. Similarly, the energy absorbed depends on the thickness and structure of the beam being cut and the shape and thickness of the cutter. The number of cuts changes the amount of energy absorbed in bending the beam to reduce that energy but increases the energy absorbed in cutting the beam because of the added points of cutting. The amount of energy selected for absorption depends upon the momentum of the vehicles that are expected to impact the terminal and the amount of de-acceleration desired.

Figure 9:
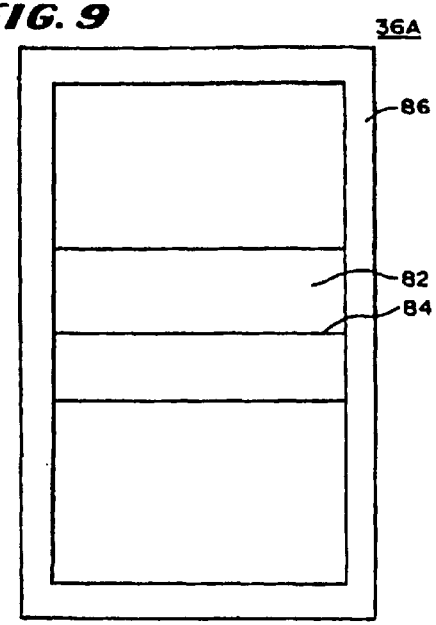
FIG. 9 is an end view of another embodiment of cutting section which may be utilized under some circumstances instead of the embodiment of FIG. 8.

In FIG. 9, there is shown another cutting section 36A having a single steel wedge 82 having a forward pointed edge 84 welded to the sides of the steel open frame 86 of the cutting section. With this embodiment, the bending loss is much greater and the cutting energy absorbed is related to the angle of the sides of the wedge in the cutting location of the beam. It may be most useful for unusually strong metal beams or beams of non-ductile material or brittle material such as fiber reinforced plastic.

Figure 10:
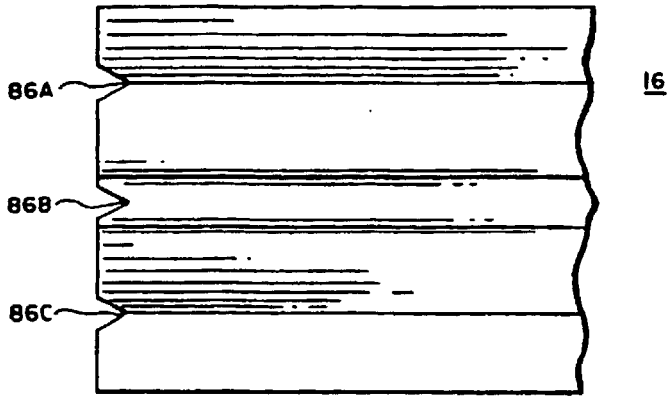
FIG. 10 is an embodiment of guardrail showing a W-beam, the end of which is cut to accommodate the cutting blades of FIG. 8.

In FIG. 10, there is shown a fragmentary view of a W-beam 16 having three V-shaped cuts 86A, 86B and 86C positioned to be aligned with the cutter blades 40A, 40B and 40C to cut the W-beam 16 at locations which form sections with low moments of inertia. In the case of a W-beam, the cuts are made at locations which reduce the overall curvature to reduce the moments of inertia and thus the force needed to bend the W-beam. Other shaped beams may be cut at different points and the energy of absorption may also be changed by changing the location of the cuts so as to increase or decrease the moments of inertia of the segments being bent aside by the deflector plate 64 (FIG. 6). For very high moments of inertia sections, the strength of the deflector plate may need to be increased. The notches are not necessary for the operation of the invention but are made for convenience in locating the cutter blades. The shape and location of the deflector plate affects the amount of energy absorbed and may be modified to increase or decrease the energy absorption per linear foot of travel of the impact head.

Figure 11:
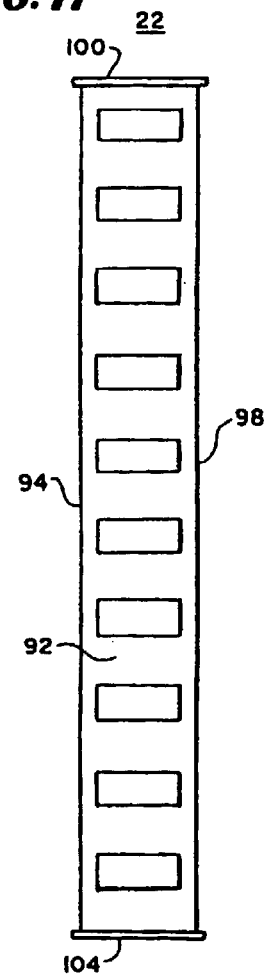
FIG. 11 is a front view of an anchor in accordance with an embodiment of the invention.
Figure 12:
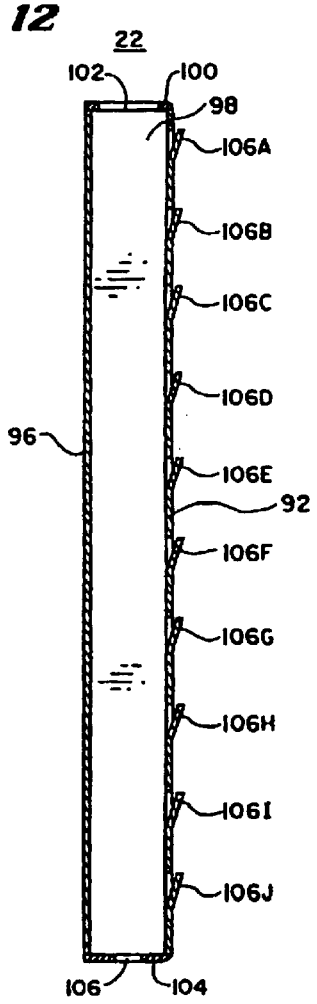
FIG. 12 is an elevational sectional view of the anchor of FIG. 11.

In FIGS. 11 and 12, there is shown a front elevational view and a side sectional view of the anchor 22 respectively having a front side 92, left side 94 (FIG. 1), a back side 96 and a right side 98, each being elongated to form a parallelepiped member that is 24 and 15/16th inches long and three and one/half inches wide and two and one/half inches deep. A first rectangular end member 100 contains a relatively large diameter opening 102 to receive a cable 26 (FIG. 1) and a second rectangular end member 104 includes a narrower opening 106 so as to permit the cable 26 to pass through and be fastened on the outside of the anchor 22. With this arrangement, the cable 26 (FIG. 1) extends through the anchor 22 and is fastened at one end thereof. On the front surface 92 are a plurality of raised portions 106A–106J which are sized to receive the tabs 50 bent outwardly from the W-beam 16 (FIG. 3) to permit the anchor 22 to be removably mounted to the W-beam 16 and to hold the cable 26 by means of the retention member or bolt 46 (FIG. 4).

In FIG. 13, there is shown a fragmentary, elevational view of the section of the W-beam 16 showing the manner in which the tabs 50A–50J that engage the cut portions 106A–106J (FIG. 12) of the anchor 22 form a connection between the rail 16 and the anchor 22. This mechanism is designed for easy connection and easy release when the post 14A (FIG. 1) is broken to release tension between the cable 26 and the anchor 22 holding the tabs within the anchor.

In FIG. 14, there is shown another embodiment of guardrail 10A serving to protect vehicles from hard structures 120 such as an overpass or the like. In this embodiment, the terminal assembly 18 is constructed in the same manner as in the embodiment of FIG. 1 although instead of a W-beam, a structural pipe may be used to cooperate with the terminal to absorb energy in the event a vehicle hits the terminal. In this embodiment, beam 130 is horizontally mounted between two parallel rails 122 and 124, each having corresponding overlapping guardrail sections 122A–122D and 124A–124D, supported by corresponding ones of the breakaway posts 126A–126D. The structure without the terminal assembly 18 and beam 130 is similar in operation and construction as that described in the aforementioned U.S. Pat. No. 4,655,434.

In this embodiment, the terminal assembly 18 operates as an energy absorbing terminal together with the energy absorbing nature of the overlapping rail sections and breakaway posts to control a vehicle and avoid its hitting the hard structure 120.

Figure 15:
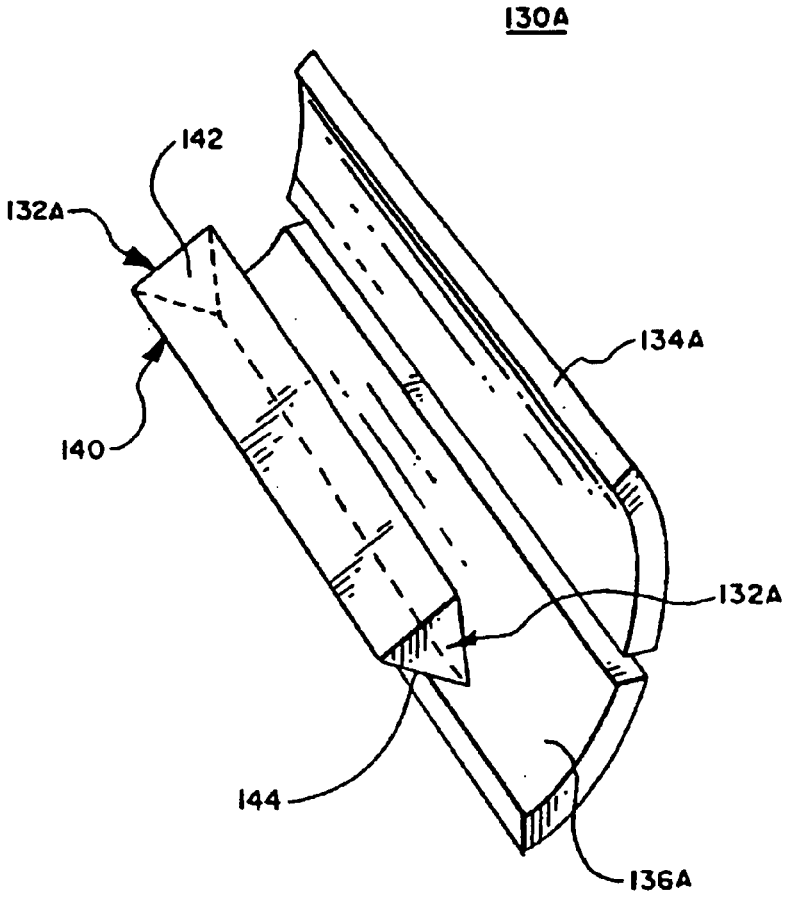
FIG. 15 is a simplified perspective view of a cutting wedge and deflector plate that may be used in the embodiment of FIG. 9.

In FIG. 15, there is shown a simplified embodiment 130A of a cutter of the type shown in FIG. 9 adapted for receiving a guardrail of fiber reinforced plastic having a cutting edge 140 adapted to receive a beam and two adjacent cutting sides 142 and 144 to split the rail. The rail fragments are deflected in opposite directions and fragmented by the deflector plates 134A and 136A which tend to bend them away from the cutting edge 140, causing fracturing of the brittle material by breaking in tension, cracking in compression and buckling. The amount of energy absorbed is determined by the size and angle of the cutting edge 140 and sides 142 and 144 and by the position and shape of the deflector plates 134A and 136A.

As can be understood from the above description, a terminal may be fabricated to provide a selected amount of energy absorption per linear foot of movement of the impact head by a vehicle by selecting the number of cutters, the shape of the cutters and the location of the cutting with respect to the thickness and strength of the guardrail member and the nature of the deflecting plate that bends the guardrail. This selection may be made to accommodate different maximum and minimum speeds on a highway and the type of vehicles that are most likely to result in bodily injury in the event that they tend to leave the roadway.

In operation, the terminals are mounted at the end of the guardrail without the need for flaring the guardrail away from the roadway. When the vehicle hits the terminal, the terminal and rail are moved with respect to each other while cutters cut the rail and a deflection plate bends it so as to absorb energy and slow the vehicle down. If the vehicle hits the guardrail itself, a tension member holds the guardrail to restrain and redirect the vehicle. This cable anchor retention member is released when a vehicle hits the terminal to avoid the connection between the terminal and the rail member from causing unintended damage to persons in the vehicle.

From the above description, it can be understood that the guardrail of this invention has several advantages, such as for example: (1) it is economical to construct; and (2) it provides greater versatility and selection of the energy-absorbing cutters to accommodate different circumstances and different types of rails.

Although a preferred embodiment of the invention has been described with particularity, many modifications and variations in the invention may be made without deviating from the invention. Therefore, it can be understood that, within the scope of the appended claims, the invention may be practiced other than described.

What is claimed is:

1. A guardrail terminal adapted to cooperate with a guardrail comprising:

an impact head; and a cutting section;

said impact head and cutting section being mounted for movement together; and said cutting section including means for cutting the guardrail when the guardrail terminal and the guardrail are moved with respect to each other.

2. A guardrail terminal in accordance with claim 1 in which the cutting section is configured to partly slit the guardrail, whereby more energy is utilized in bending the guardrail as a unit than would be the case if it were completely severed.

3. A guardrail terminal in accordance with claim 1 in which the cutting section is configured to severs the guardrail to cause longitudinal separation between portions of the guardrail.

4. A guardrail terminal according to claim 1 in which the cutting section includes a wedge shaped cutter and at least one deflection plate positioned near the wedged shaped cutter to fragment sections of the guardrail.

5. A guardrail terminal according to claim 1 in which the cutting section includes at least one deflection plate means positioned to deflect sections of the guardrail after the guardrail is cut.

6. A guardrail terminal according to claim 1 in which the cuffing section includes a plurality of cutters adjacent to each other; and each of said cutters being shaped to deflect a cut section of the guardrail in the opposite direction as an adjacent cut section of the guardrail.

7. A guardrail terminal according to claim 1 further including at least one deflection plate.

8. A method of manufacturing a guardrail terminal comprising the steps of:

selecting a predetermined number of cutters; and positioning the cutters in a cutting section adapted to receive a guardrail;

said step of selecting a predetermined number of cutters including the step of shaping a cutter in accordance with the amount of energy absorbed when the cutter cuts a predetermined rail.

9. A method of manufacturing a guardrail terminal in accordance with claim 8 in which the step of selecting a predetermined number of cutters includes the substep of selecting the number of cutters in accordance with the amount of energy intended to be absorbed upon impact with a vehicle with an expected momentum and desired deceleration.

10. A method of manufacturing a guardrail terminal in accordance with claim 8 further including the step of positioning the cutters in accordance with the amount of energy intended to be absorbed upon impact by vehicles whereby desired deceleration may be obtained by selecting moments of inertia of sections of the guardrail.

11. A method of manufacturing a guardrail terminal in accordance with claim 8 in which the step of selecting a predetermined number of cutters includes the substep of selecting the number of cutters in accordance with the amount of energy intended to be absorbed upon impact with vehicles with an expected momentum and desired deceleration.

12. A method of avoiding bodily damage to an occupant of a vehicle colliding with a guardrail system, comprising the steps of:

causing a guardrail terminal to move with respect to a guardrail and to cut the guardrail when impacted by a vehicle;

causing the guardrail to release a cable holder when impacted by a vehicle; and causing a vehicle hitting the guardrail to be redirected to a safer direction.

13. A method in accordance with further including the steps of:

cutting a fiber reinforced guardrail to form guardrail sections; and fragmenting the fiber reinforced guardrail sections against a deflecting surface, wherein the sections are sufficiently small to form points of fracture near the deflecting surface.

14. A method of avoiding bodily damage to an occupant of a vehicle colliding with a guardrail system, in accordance with claim 12 further including the step of causing the guardrail terminal to cut and bend the guardrail so as to decelerate the vehicle.

15. A method of avoiding of avoiding bodily damage to an occupant of a vehicle colliding with a guardrail system, in accordance with claim 12 further including the step of causing the guardrail terminal to cut the guardrail into a number of sections and bend the sections of the guardrail so as to decelerate the vehicle.

16. A method of manufacturing a guardrail terminal comprising the steps of:

selecting a predetermined number of cutters; and positioning the cutters in a cutting section adapted to receive a guardrail;

said step of selecting a predetermined number of cutters including the substep of selecting the number of cutters in accordance with the amount of energy intended to be absorbed upon impact with vehicles with an expected momentum and desired deceleration.

17. A method of manufacturing a guardrail terminal in accordance with claim 16 further including the step of positioning the cutters in accordance with the amount of energy intended to be absorbed upon impact with vehicles with an expected momentum and a desired deceleration by selecting moments of inertia of sections of the guardrail cut by the cutters and bent after being cut.

18. A method of manufacturing a guardrail terminal in accordance with claim 16 in which the step of selecting a predetermined number of cutters includes the substep of selecting the number of cutters in accordance with the amount of energy intended to be absorbed upon impact with vehicles with an expected momentum and desired deceleration.

19. A method of avoiding bodily damage to an occupant of a vehicle colliding with a guardrail system, comprising the steps of:

causing a guardrail terminal to move with respect to a guardrail upon being impacted by a vehicle;

causing the terminal to cut the guardrail as the terminal moves with respect to the guardrail whereby energy is absorbed by the cutting of the guardrail and the movement of the vehicle is decelerated; and causing the terminal to bend the guardrail as the terminal and guardrail move with respect to each other whereby further energy is absorbed.

20. A method of avoiding bodily damage to an occupant of a vehicle colliding with a guardrail system, in accordance with claim 19 further including the step of causing the guardrail terminal to cut the guardrail into a number of sections and bend the sections of the guardrail so as to decelerate the vehicle.

21. An energy-absorption system for positioning along a roadway to absorb the energy of an errant vehicle, the energy-absorption system comprising:

an impact head;

a cutter; and a cuttable member;

wherein the impact head is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle.

22. The energy-absorption system of claim 21 further including:

a deflector positioned to bend at least a portion of the cuttable member away from the path of the errant vehicle.

23. The energy-absorption system of claim 21 wherein the cuttable member is a structural pipe.

24. An energy-absorption system for positioning along a roadway to absorb the energy of an errant vehicle, the energy-absorption system comprising:

an impact head;

an angled cutter; and an elongated cuttable member horizontally mounted between (when viewed from above) two parallel guardrails;

wherein the energy-absorption system is positionable along a roadway to cooperate with the upstream portion of a roadside hazard; and wherein the impact head is in operational with the cutter and the cuttable member such that the impact of an errant vehicle with the impact head will cause the cutter to cut at least a portion of the cuttable member to absorb the impact energy of the errant vehicle.

25. The energy-absorption system of claim 24 wherein each of the two parallel guardrails is constructed of overlapping guardrail sections.

26. The energy-absorption system of claim 25 wherein at least one of the two parallel guardrails is supported by at least one corresponding break-away post.

27. The energy-absorption system of claim 25 further including:

a deflector positioned to bend at least a portion of the cuttable member away from the path of the errant vehicle.

28. The energy-absorption system of claim 25 wherein the cuttable member is a structural pipe.

29. The energy-absorption system of claim 24 wherein at least one of the two parallel guardrails is supported by at least one corresponding break-away post.

30. The energy-absorption system of claim 24 further including:

a deflector positioned to bend at least a portion of the cuttable member away from the path of the errant vehicle.

31. The energy-absorption system of claim 24 wherein the cuttable member is a structural pipe.

32. The energy-absorption system of claim 24 wherein the angled cutter comprises a cutter that is positioned such that at least one edge of the cutter approaches the cuttable member at an acute angle.

33. The energy-absorption system of claim 32 wherein the angled cutter comprises two plates that form an acute angle where the edges of the two plates cross at a point.

34. The energy-absorption system of claim 32 wherein the angled cutter comprises a wedge having a forward pointed edge.

35. An energy-absorption system for positioning along a roadway to absorb the energy of an errant vehicle, the energy-absorption system comprising:

an impact head;

an angled cutter;

two parallel guardrails, each of which is constructed of overlapping guardrail sections; and an elongated cuttable member mounted horizontally between (when viewed from above) the two parallel guardrails;

wherein the energy-absorption system is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle.

36. The energy-absorption system of claim 35 wherein at least one of the two parallel guardrails is supported by at least one corresponding break-away post.

37. The energy-absorption system of claim 35 further including:

a deflector positioned to bend at least a portion of the cuttable member away from the path of the errant vehicle.

38. The energy-absorption system of claim 35 wherein the cuttable member is a structural pipe.

39. An energy-absorption system for positioning along a roadway to absorb the energy of an errant vehicle, the energy-absorption system comprising:

an impact head;

an angled cutter;

two parallels guardrails, each of which is constructed of overlapping guardrail sections;

at least one break-away post supporting at least one of the two parallel guardrails; an elongated cuttable member formed of a structural pipe mounted horizontally between (when viewed form above) the two parallel guardrails;

wherein the energy-absorption system is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle; and a deflector positioned to bend at least a portion of the cuttable member away from the path of the errant vehicle.

* * * * *